US009097194B2

(12) United States Patent
Suzuki et al.

(10) Patent No.: US 9,097,194 B2
(45) Date of Patent: Aug. 4, 2015

(54) CONTROL DEVICE CONTROLLING SENSOR HEATING IN INTERNAL COMBUSTION ENGINE

(75) Inventors: Kunihiko Suzuki, Mito (JP); Toshio Hori, Hitachinaka (JP); Koji Matsufuji, Hitachinaka (JP); Kenji Takada, Hitachi (JP); Heikichi Kamoshita, Hitachinaka (JP); Hiroshi Sekine, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 191 days.

(21) Appl. No.: 13/551,401

(22) Filed: Jul. 17, 2012

(65) Prior Publication Data

US 2013/0024088 A1 Jan. 24, 2013

(30) Foreign Application Priority Data

Jul. 19, 2011 (JP) ..... 2011-158269

(51) Int. Cl.
*F02D 41/00* (2006.01)
*F02D 41/14* (2006.01)
*F02D 41/06* (2006.01)

(52) U.S. Cl.
CPC ..... *F02D 41/1494* (2013.01); *F02D 41/062* (2013.01); *F02D 41/1445* (2013.01); *F02D 41/1446* (2013.01); *F02D 2041/1433* (2013.01); *F02D 2041/1472* (2013.01)

(58) Field of Classification Search
CPC ..... F02D 41/1445; F02D 41/1446; F02D 41/1494; F02D 41/1495; F02D 41/062; F02D 2041/1472; F02D 2041/1433
USPC ..... 701/102; 123/697, 406.55, 676; 73/114.71
See application file for complete search history.

(56) References Cited

U.S. PATENT DOCUMENTS 6,304,813 B1 * 10/2001 Ikeda et al. ..... 701/109
6,935,101 B2 * 8/2005 Morinaga et al. ..... 60/284

(Continued)

FOREIGN PATENT DOCUMENTS

JP 2004-353495 A 12/2004
JP 2005-067952 A 3/2005

(Continued)

OTHER PUBLICATIONS

Heywood, John B.; Chapter 4: Properties of Working Fluids; 1988; pp. 100-107; Internal Combustion Engine Fundamentals; McGraw-Hill, Inc.; ISBN: 0-07-028637-X.

(Continued)

*Primary Examiner* — Lindsay Low
*Assistant Examiner* — Robert Werner
(74) *Attorney, Agent, or Firm* — Foley & Lardner LLP

(57) ABSTRACT

Control device of an internal combustion engine that determines whether or not to perform sensor element heating control of an air-fuel ratio sensor with high accuracy based on the mass of condensed water in an exhaust pipe. The control device computes the rate of change of condensed water mass in an exhaust pipe based on the saturated water vapor pressure and the water vapor partial pressure of exhaust gas, and computes the rate of change of evaporation mass in the exhaust pipe based on the amount of heat which the condensed water receives in the exhaust pipe. The control device updates the mass of condensed water based on the rate of change of condensed water mass and the rate of change of evaporation mass, and determines whether or not to perform heating control by a heating controlling unit based on the updated mass of condensed water.

7 Claims, 21 Drawing Sheets

(56) References Cited

U.S. PATENT DOCUMENTS

| | | | | |
|---|---|---|---|---|
| 7,316,157 | B2 | 1/2008 | Ohsaki | |
| 7,418,957 | B2 * | 9/2008 | Abe | 123/697 |
| 7,536,999 | B2 | 5/2009 | Ootake et al. | |
| 7,805,928 | B2 * | 10/2010 | Shouda et al. | 60/285 |

FOREIGN PATENT DOCUMENTS

| | | | |
|---|---|---|---|
| JP | 2007-009878 | A | 1/2007 |
| JP | 2008-190522 | A | 8/2008 |
| JP | 2009-228564 | | 10/2009 |
| JP | 2009-299631 | A | 12/2009 |
| JP | 2010-121574 | A | 6/2010 |
| JP | 2010-145256 | A | 7/2010 |
| JP | 2010-174657 | A | 8/2010 |
| JP | 4618312 | B2 * | 1/2011 |

OTHER PUBLICATIONS

Equations describing the physical properties of moist air; [online] Retrieved in Nov. 2014 from the Internet: <URL: http://www.conservationphysics.org/atmcalc/atmoclc2.pdf>; pp. 1-4.

* cited by examiner

OPERATION/STOP
(START)
ELAPSED TIME

EXHAUST GAS MASS FLOW RATE
ELAPSED TIME

EXHAUST GAS TEMPERATURE
ELAPSED TIME

EXHAUST PIPE TEMPERATURE
DEW POINT
ELAPSED TIME

MASS OF CONDENSED WATER
STANDARD FOR DETERMINATION
ELAPSED TIME

HEATING CONTROL DETERMINATION RESULT
HEATING IS ALLOWED
HEATING IS NOT ALLOWED
ELAPSED TIME

OPERATION /STOP
(START)
(STOP)
(RESTART)
ELAPSED TIME

EXHAUST GAS MASS FLOW RATE
ELAPSED TIME

EXHAUST GAS TEMPERATURE
ELAPSED TIME

EXHAUST PIPE TEMPERATURE
DEW POINT
ELAPSED TIME

MASS OF CONDENSED WATER
STANDARD FOR DETERMINATION
ELAPSED TIME

HEATING CONTROL DETERMINATION RESULT
HEATING IS ALLOWED
HEATING IS NOT ALLOWED
A
B
C
D
ELAPSED TIME

OPERATION/STOP
(START)
ELAPSED TIME

EXHAUST GAS MASS FLOW RATE
ELAPSED TIME

EXHAUST GAS TEMPERATURE
ELAPSED TIME

EXHAUST PIPE TEMPERATURE
DEW POINT
ELAPSED TIME

MASS OF CONDENSED WATER
STANDARD FOR DETERMINATION
ELAPSED TIME

HEATING CONTROL DETERMINATION RESULT
A
B
ELAPSED TIME

OPERATION /STOP
(START)
(STOP )
(RESTART)
ELAPSED TIME

EXHAUST GAS MASS FLOW RATE
ELAPSED TIME

EXHAUST GAS TEMPERATURE
ELAPSED TIME

EXHAUST PIPE TEMPERATURE
DEW POINT
ELAPSED TIME

MASS OF CONDENSED WATER
STANDARD FOR DETERMINATION
ELAPSED TIME

HEATING CONTROL DETERMINATION RESULT
HEATING IS ALLOWED
HEATING IS NOT ALLOWED
A
B
C
D
ELAPSED TIME

CONTROL DEVICE CONTROLLING SENSOR HEATING IN INTERNAL COMBUSTION ENGINE

CROSS-REFERENCE TO RELATED PATENT APPLICATIONS

Japan Priority Application 2011-158269, filed Jul. 19, 2011 including the specification, drawings, claims and abstract, is incorporated herein by reference in its entirety.

BACKGROUND OF THE INVENTION

1. Field of the Invention

The present invention relates to a control device of an internal combustion engine, the control device that determines whether or not to perform sensor element heating control of an air-fuel ratio sensor based on the mass of condensed water that develops in an exhaust pipe.

2. Description of the Related Art

JP-A-2009-228564 discloses the technology to compute the mass of condensed water by map-computing the condensed water integrated quantity based on a relative wall temperature which is a difference between an estimated exhaust pipe temperature and the dew point and an exhaust gas mass flow rate and adding the condensed water integrated quantity to a previous value in a control device of an exhaust gas sensor, the control device that controls the energization state of a heater that heats the exhaust gas sensor provided in an exhaust pipe of an internal combustion engine. The condensed water integrated quantity map is set so that the mass of condensed water is decreased as the relative wall temperature rises and the condensed water integrated quantity takes a negative value when the exhaust gas mass flow rate is more than or equal to a reference value. The technology to permit the energization of the heater that heats the exhaust gas sensor when it is determined that no condensed water is present in the exhaust pipe based on the computed mass of condensed water is disclosed.

However, after the internal combustion engine is started, a large part of the period in which the condensed water is present in the exhaust pipe is an evaporation process in which the exhaust pipe is above the dew point, and, since transfer of mass and energy between the exhaust gas and the condensed water is an important factor during the evaporation process, it is impossible to compute the amount of condensed water with high accuracy based only on the relative wall temperature and the exhaust gas mass flow rate.

Therefore, when the heater is started at a time point earlier than an original time point at which the condensed water disappears completely, a crack appears in the sensor element due to immersion in water. On the other hand, when the heater is started at a time point later than a time point at which the condensed water disappears completely, a reduction in the accuracy of air-fuel ratio control at start-up causes a decrease in exhaust performance.

SUMMARY OF THE INVENTION

In view of the problems mentioned above, it is an object of the present invention to provide a control device of an internal combustion engine, the control device that determines whether or not to perform sensor element heating control of an air-fuel ratio sensor with high accuracy based on the mass of condensed water that develops in an exhaust pipe.

To solve the problems mentioned above, a control device of an internal combustion engine, the control device according to an aspect of the invention, computes the rate of change of condensed water mass in an exhaust pipe based on the saturated water vapor pressure and the water vapor partial pressure of exhaust gas, and computes the rate of change of evaporation mass in the exhaust pipe based on the amount of heat which the condensed water in the exhaust pipe receives. Then, the control device updates the mass of condensed water in the exhaust pipe based on the rate of change of condensed water mass and the rate of change of evaporation mass, and determines whether or not to perform heating control by a heating controlling unit based on the updated mass of condensed water.

According to the aspect of the invention, it is possible to compute the mass of condensed water in the exhaust pipe with high accuracy and determine whether or not to perform sensor element heating control of the air-fuel ratio sensor with high accuracy. This makes it possible to prevent a crack in the sensor element of the air-fuel ratio sensor appropriately, the crack that would appear when the sensor element of the air-fuel ratio sensor is immersed in water, when the internal combustion engine is started and prevent a decrease in fuel efficiency and exhaust performance. Other problems, configurations, and effects will be made clear in the following embodiments.

DESCRIPTION OF THE PREFERRED EMBODIMENTS

Hereinafter, embodiments of the invention will be described based on the drawings.

First Embodiment

Figure 1:
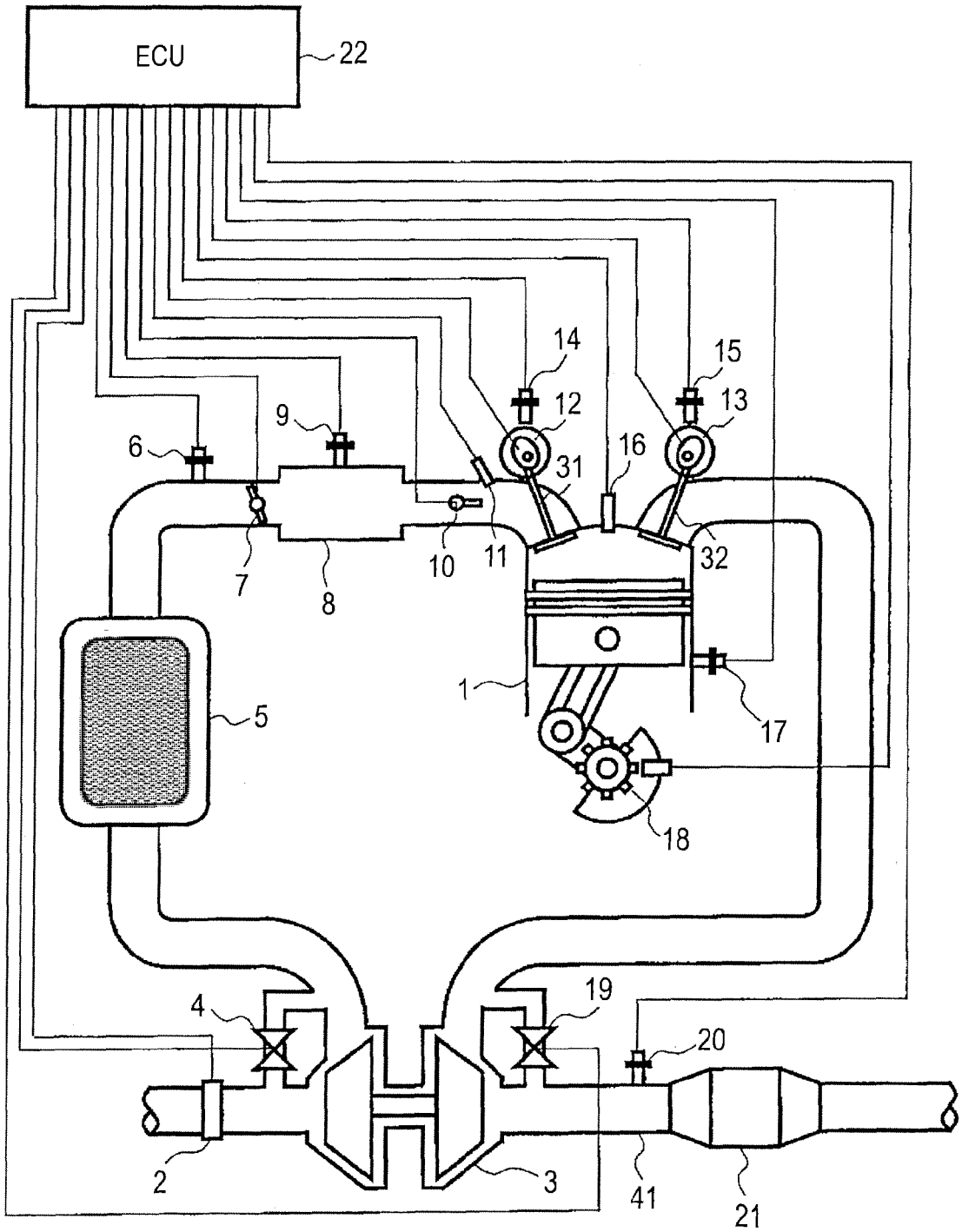
FIG. 1 is a diagram illustrating the structure of an engine system in a first embodiment.

FIG. 1 is a diagram illustrating an engine system in a structure of a first embodiment. The engine system of this embodiment is an engine system for an automobile and includes an internal combustion engine 1. An intake passage and an exhaust passage communicate with the internal combustion engine 1. To the intake passage, an air flow sensor and an intake air temperature sensor 2 incorporated into the air flow sensor are attached. To the intake passage and the exhaust passage, a turbosupercharger 3 is connected. The turbosupercharger 3 has a compressor connected to the intake passage and a turbine connected to the exhaust passage. The turbosupercharger 3 is formed of the turbine for converting the energy of exhaust gas into rotation of a turbine blade and the compressor for compressing intake air by the rotation of a compressor blade connected to the turbine blade. In a downstream part on that side of the turbosupercharger 3 where the compressor is disposed, an intercooler 5 for cooling the temperature of intake air that has risen due to adiabatic compression is provided. In a downstream part of the intercooler 5, a supercharged air temperature sensor 6 for measuring the temperature of the cooled supercharged air is attached. In a downstream part of the supercharged air temperature sensor 6, a throttle valve 7 for controlling the amount of intake air that flows into a throttle cylinder through the intake passage is provided. The throttle valve 7 is an electronically controlled throttle valve that can control the degree of throttle opening independently of the extent to which the accelerator is pressed on.

In a downstream part of the throttle valve 7, an intake manifold 8 is connected. The intercooler may be formed integrally with the intake manifold 8 lying downstream of the throttle valve 7. This makes it possible to reduce the volume of a portion from the downstream of the compressor to the cylinder and make the torque more responsive. To the intake manifold 8, a supercharging pressure sensor 9 is attached. In a downstream part of the intake manifold 8, a tumble control valve 10 that makes the flow inside the cylinder turbulent by generating a drift in the intake air and an injector 11 that injects fuel into an inlet port are disposed. The injector may adopt a method of directly injecting the fuel into the cylinder.

The internal combustion engine 1 includes variable valve mechanisms 12 and 13 that can continuously vary the phase of valve opening and closing in an induction valve 31 and an exhaust valve 32, respectively. To the variable valve mechanisms 12 and 13, sensors 14 and 15 for sensing the phase of valve opening and closing are attached to the induction valve 31 and the exhaust valve 32, respectively. To a cylinder head section, a spark plug 16 with an electrode section exposed in the cylinder, the spark plug 16 igniting a combustible gas mixture by a spark, is attached. Furthermore, to the cylinder, a knock sensor 17 sensing the occurrence of a knock is attached. To a crank shaft, a crank angle sensor 18 is attached. This makes it possible to detect the rotational speed of the internal combustion engine 1 based on a signal that is output from the crank angle sensor 18.

To an exhaust pipe 41 forming part of the exhaust passage, an air-fuel ratio sensor 20 is attached, and feedback control is performed in such a way that the fuel injection quantity supplied from the injector 11 becomes a target air fuel ratio based on the detection result of the air-fuel ratio sensor 20. In a downstream part of the air-fuel ratio sensor 20, an exhaust gas purification catalyst 21 is provided, and toxic exhaust gas components such as carbon monoxide, nitrogen oxides, and unburned hydrocarbons are purified by catalytic reaction.

The turbosupercharger 3 is provided with an air bypass valve 4 and a waste gate valve 19. The air bypass valve 4 is provided to prevent the pressure from a downstream part of the compressor to an upstream part of the throttle valve 7 from rising excessively. By opening the air bypass valve 4 when the throttle valve 7 is closed abruptly in a supercharged state, the gas in the downstream part of the compressor is made to flow back to the upstream part of the compressor, making it possible to reduce the supercharging pressure. On the other hand, the waste gate valve 19 is provided to prevent the internal combustion engine 1 from reaching an excessively high supercharging level. When the supercharging pressure sensed by the supercharging pressure sensor 9 reaches a predetermined value, the waste gate valve 19 is opened and the exhaust gas is guided to pass outside the exhaust gas turbine. This makes it possible to prevent or maintain supercharging.

As shown in FIG. 1, the engine system in this embodiment includes an ECU (electronic controlling unit) 22. To the ECU 22, the various sensors and actuators described above are connected. The actuators such as the throttle valve 7, the injector 11, the variable valve mechanisms 12 and 13 are controlled by the ECU 22. Furthermore, the operating state of the internal combustion engine 1 is sensed based on the signals input from the various sensors described above, and the spark plug 16 ignites the combustible gas mixture with timing determined by the ECU 22 in accordance with the operating state.

Figure 2:
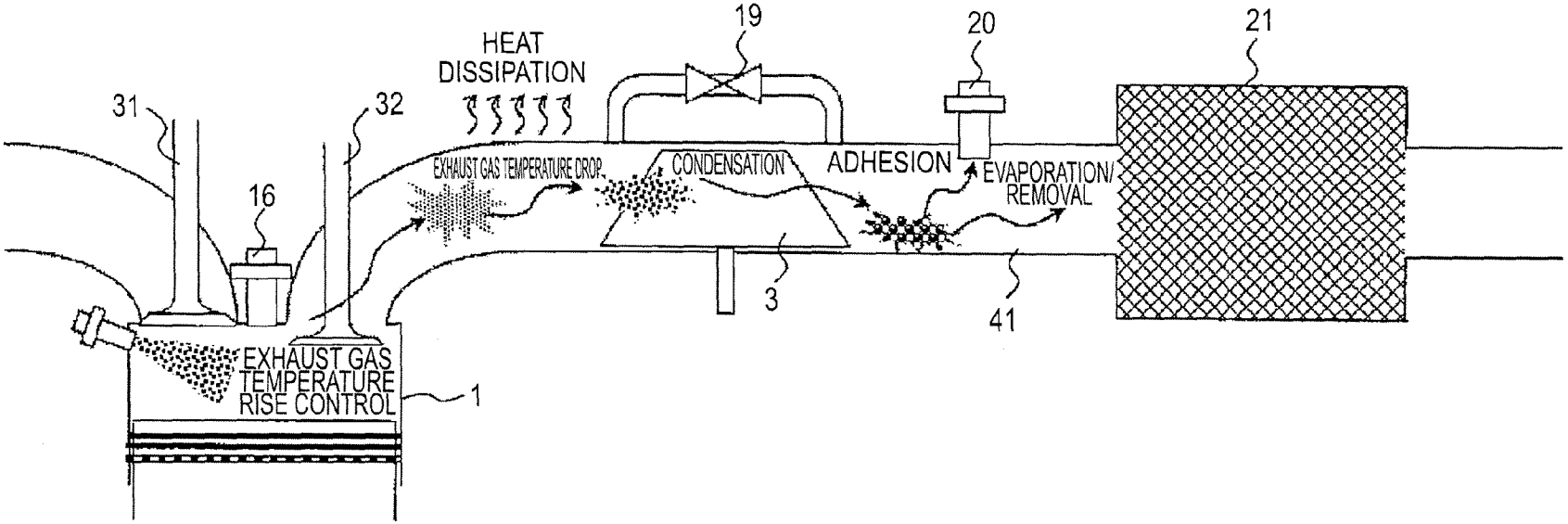
FIG. 2 is a diagram illustrating a mechanism of the development of condensed water in an exhaust pipe.

FIG. 2 is a diagram illustrating a mechanism of the development of condensed water in an exhaust pipe. The water vapor in the exhaust gas discharged from the cylinder of the internal combustion engine 1 through the exhaust valve 32 when the internal combustion engine is started is cooled by heat transfer to the exhaust pipe 41 and the turbosupercharger 3. When the water vapor reaches the dew point (the dew-point temperature), condensed water develops, adheres to the inner wall surface of the exhaust pipe 41, and builds up. When the condensed water adheres to a sensor element (not shown) of the air-fuel ratio sensor 20 heated to the activation temperature by the flow of the exhaust gas, an element crack may by produced by thermal shock. To prevent an element crack appropriately, it is necessary to sense the mass of condensed water that has built up in the exhaust pipe 41 and determine whether or not to perform energization to heat the sensor element of the air-fuel ratio sensor 20 based on the mass of condensed water.

Figure 3:
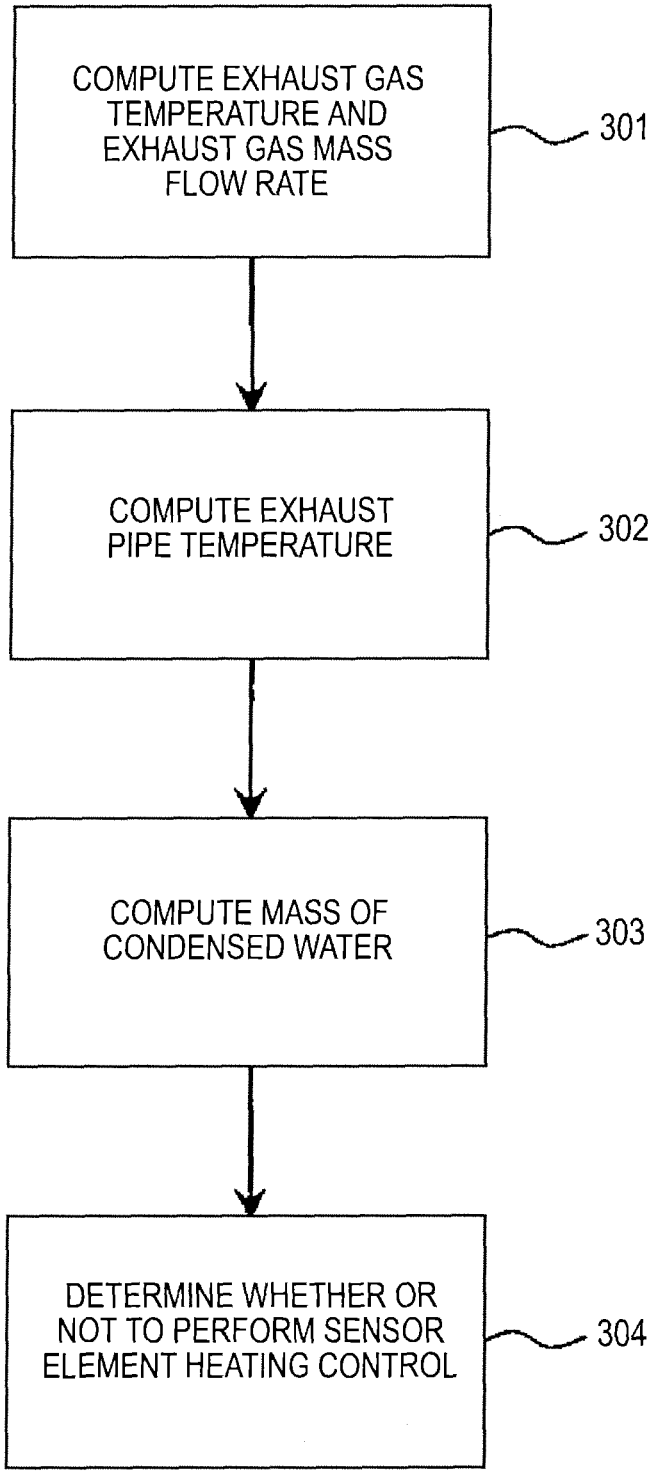
FIG. 3 is a flowchart of the procedure for determining whether or not to perform sensor element heating control of an air-fuel ratio sensor.

FIG. 3 is a flowchart of the procedure for determining whether or not to perform sensor element heating control. The processing in steps 301 to 304 shown in FIG. 3 is repeatedly performed in a predetermined program cycle in the ECU 22, for example.

First, in step 301, an exhaust gas temperature and an exhaust gas mass flow rate are computed. Then, in step 302, an exhaust pipe temperature is computed based on the exhaust gas temperature and the exhaust gas mass flow rate. In step 303, the mass of condensed water is computed based on the exhaust gas temperature, the exhaust gas mass flow rate, and the exhaust pipe temperature. This makes it possible to keep track of the mass of condensed water in the exhaust pipe 41 accurately.

Then, in step 304, sensor element heating control determination processing is performed to determine whether or not to perform energization to heat the sensor element of the air-fuel ratio sensor 20 based on the mass of condensed water. For example, when the mass of condensed water is more than a previously set reference level, it is determined that sensor element heating control is not allowed because the adhesion of the condensed water may produce a sensor crack; when the mass of condensed water is less than or equal to the previously set reference level, it is determined that sensor element heating control is allowed because there is no possibility of a sensor crack.

With this configuration, it is possible to determine whether or not to perform sensor element heating control of the air-fuel ratio sensor 20 with high accuracy, prevent an element crack that would appear in the sensor element due to the condensed water, and improve the exhaust performance at the start of cooling of the internal combustion engine by eliminating waste which would be generated before initiation of exhaust gas air-fuel ratio feedback control.

Moreover, in the engine system of this embodiment, the exhaust gas temperature and the exhaust pipe temperature are computed. However, the invention is not limited to this configuration. That is, a configuration in which the exhaust gas temperature and the exhaust pipe temperature may be directly sensed by a temperature sensor may be adopted. Such a configuration can also produce the advantages similar to those of the above-described configuration in which the exhaust gas temperature and the exhaust pipe temperature are computed.

Figure 4:
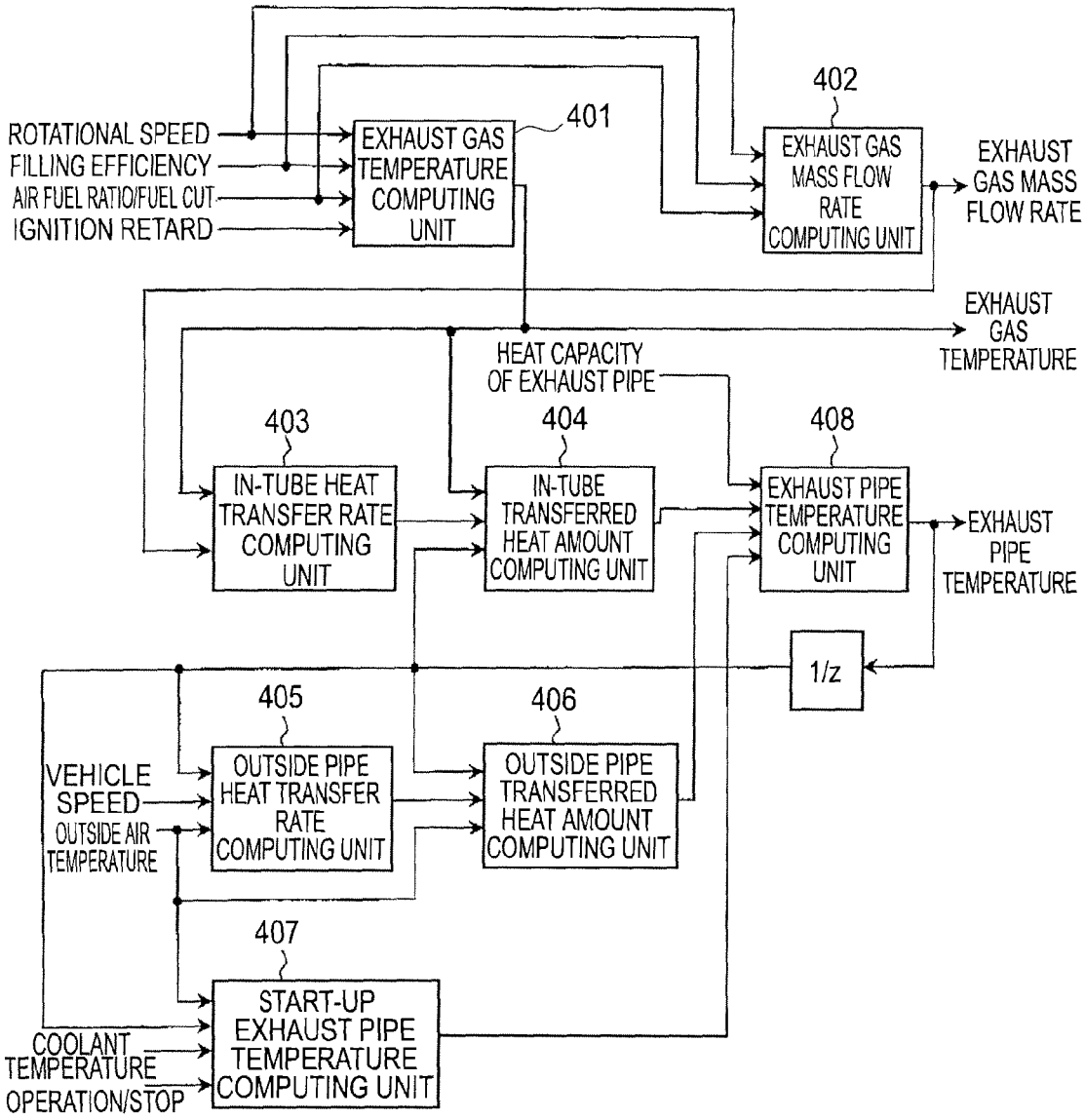
FIG. 4 is a block diagram showing how to compute the exhaust gas mass flow rate, the exhaust gas temperature, and the exhaust pipe temperature.

FIG. 4 is a block diagram showing how to compute the exhaust gas mass flow rate, the exhaust gas temperature, and the exhaust pipe temperature. This block diagram indicates the detailed computing processing in steps 301 and 302 in FIG. 3.

In an exhaust gas temperature computing unit of block 401, the exhaust gas temperature of the exhaust gas flowing through the exhaust pipe 41 is computed based on the rotational speed, the filling efficiency, the air fuel ratio, the fuel cut flag, and an ignition time point controlled variable such as ignition retard. In an exhaust gas mass flow rate computing unit of block 402, the exhaust gas mass flow rate of the exhaust gas flowing through the exhaust pipe 41 is computed based on the rotational speed, the filling efficiency, the air fuel ratio, and the fuel cut flag.

In an in-tube heat transfer rate computing unit of block 403, the rate of in-tube heat transfer from the exhaust gas flowing through the exhaust pipe 41 to the inner wall surface of the exhaust pipe 41 is computed based on the exhaust gas temperature and the exhaust gas mass flow rate. In an in-tube transferred heat amount computing unit of block 404, the amount of in-tube heat transferred from the exhaust gas flowing through the exhaust pipe 41 to the inner wall surface of the exhaust pipe 41 is computed based on the exhaust gas temperature, the exhaust pipe temperature, and the rate of in-tube heat transfer.

On the other hand, in an outside pipe heat transfer rate computing unit of block 405, the rate of heat transferred from the outer wall surface of the exhaust pipe 41 to the outside air (the rate of heat transfer outside the pipe) is computed based on the exhaust pipe temperature, the outside air temperature sensed by the intake air temperature sensor 2 built into the air flow sensor, and the vehicle speed. In an outside pipe transferred heat amount computing unit of block 406, the amount of heat transferred from the outer wall surface of the exhaust pipe 41 to the outside air is computed based on the exhaust pipe temperature, the outside air temperature, and the rate of heat transfer outside the pipe.

In a start-up exhaust pipe temperature computing unit of block 407, the exhaust pipe temperature at the time of start-up of the internal combustion engine is computed based on the exhaust pipe temperature, the outside air temperature, the coolant temperature, and the information on the operating state (operation/stop) of the internal combustion engine 1. In an exhaust pipe temperature computing unit of block 408, the exhaust pipe temperature is computed based on the amount of heat transferred in the exhaust pipe, the amount of heat transferred outside the exhaust pipe, the start-up exhaust pipe temperature, and the heat capacity of the exhaust pipe 41. With this configuration, it is possible to compute the exhaust pipe temperature with high accuracy by paying close consideration to the heat transfer phenomenon inside and outside the exhaust pipe 41. Moreover, there is no need to provide a temperature sensor to detect the exhaust gas temperature and the exhaust pipe temperature, which makes it possible to reduce costs.

Figure 5:
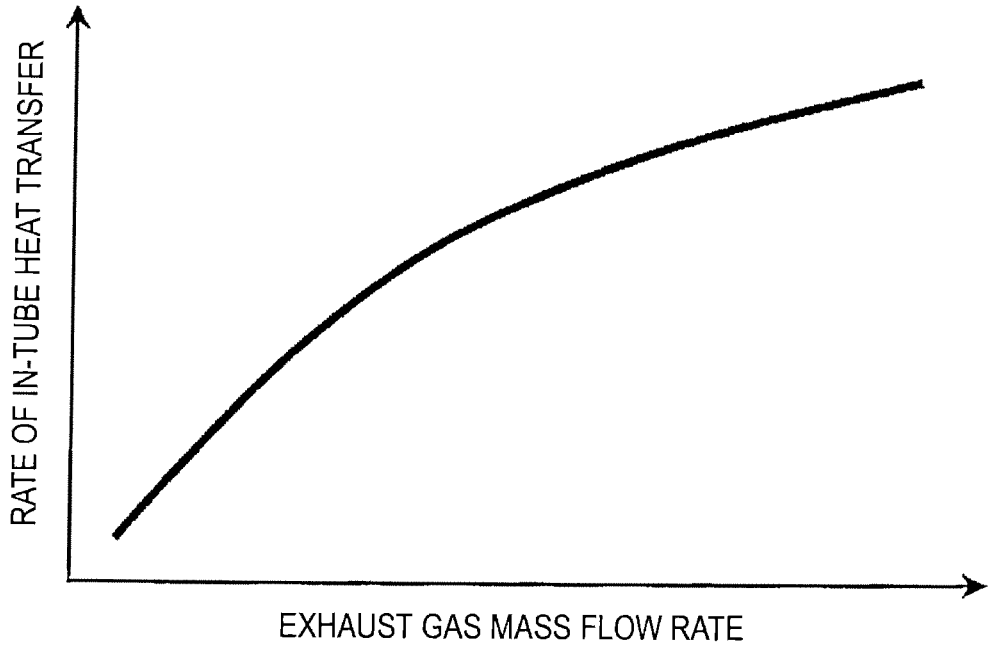
FIG. 5 is a diagram explaining the relationship between the exhaust gas mass flow rate and the rate of in-tube heat transfer.

FIG. 5 is a diagram explaining the relationship between the exhaust gas mass flow rate and the rate of in-tube heat transfer. The flow of the exhaust gas in the exhaust pipe 41 is turbulent, and the rate of in-tube heat transfer tends to increase as the exhaust gas mass flow rate increases. The in-tube heat transfer rate computing unit of block 403 in FIG. 4 has tabular data on the above-described relationship between the exhaust gas mass flow rate and the rate of in-tube heat transfer, and the rate of in-tube heat transfer is determined by table computation by using the exhaust gas mass flow rate as an argument. With this configuration, it is possible to pay due consideration to the influence of the exhaust gas mass flow rate on the rate of in-tube heat transfer and predict the exhaust pipe temperature with high accuracy.

Figure 6A:
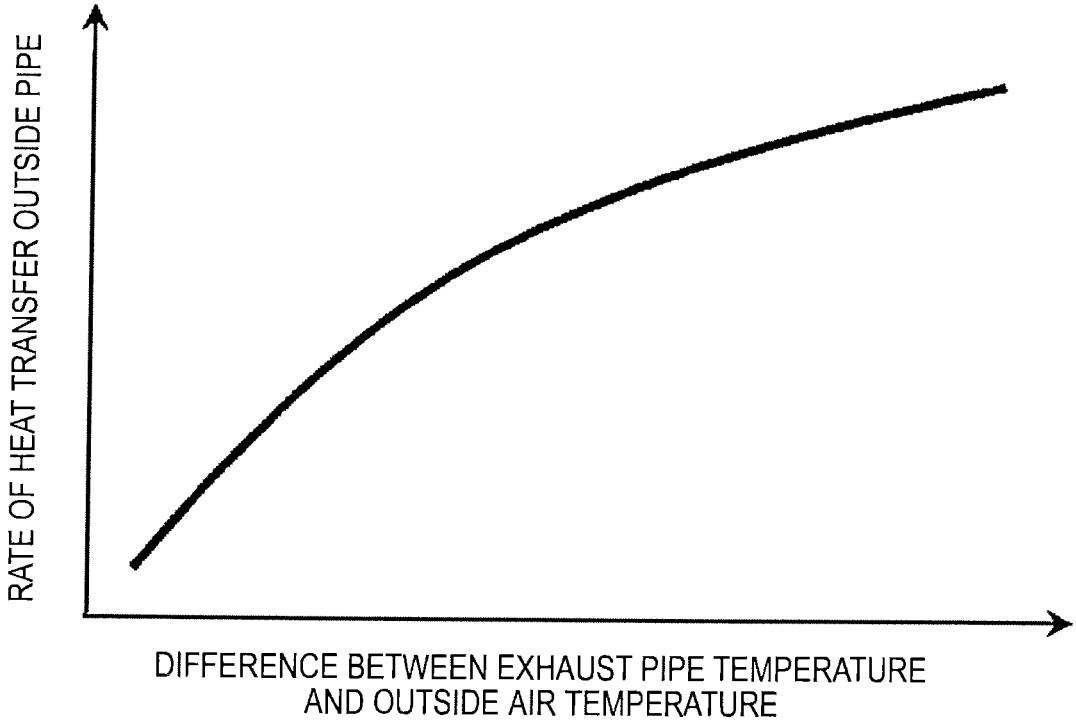
FIGS. 6A and 6B are diagrams explaining the relationship between a difference between the exhaust pipe temperature and the outside air temperature and the rate of heat transfer outside the pipe and the relationship between the vehicle speed and the rate of heat transfer outside the pipe.
Figure 6B:
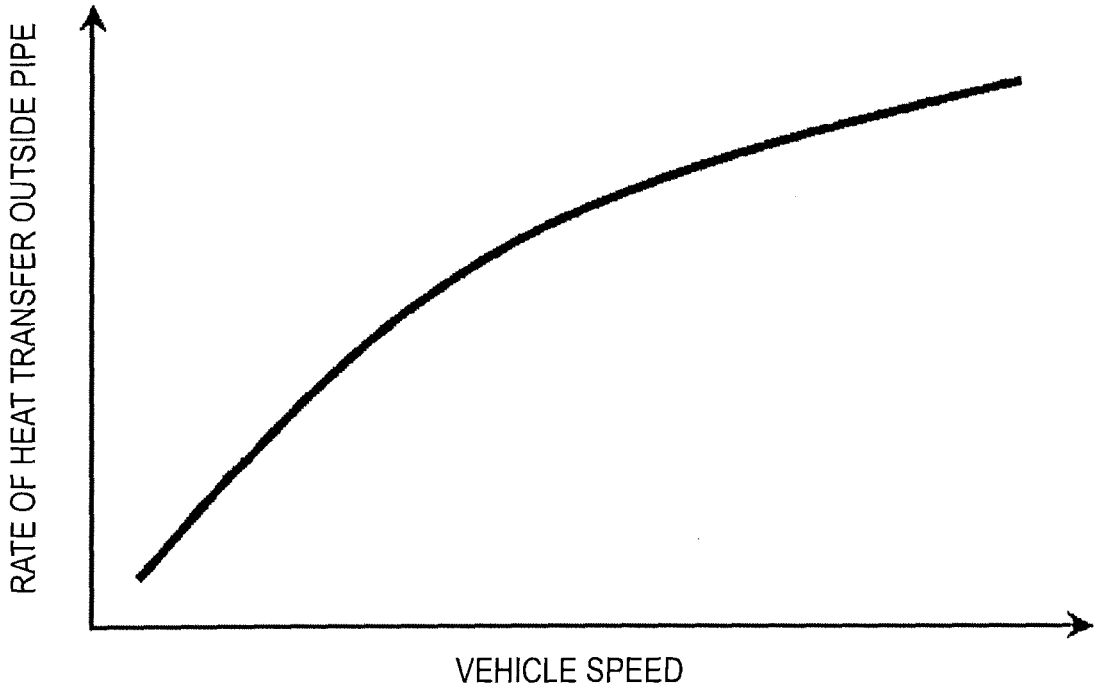

FIG. 6A is a diagram explaining the relationship between a difference between the exhaust pipe temperature and the outside air temperature and the rate of heat transfer outside the pipe, and FIG. 6B is a diagram explaining the relationship between the vehicle speed and the rate of heat transfer outside the pipe. Heat transfer outside the pipe can be classified into natural convection heat transfer which is heat transfer outside the pipe that occurs mainly due to a buoyant force acting on the air around the exhaust pipe by a temperature difference between the exhaust pipe and the outside air and forced-convection heat transfer which is heat transfer outside the exhaust pipe that occurs mainly due to a turbulent state of the air around the exhaust pipe.

Under natural convection conditions, the rate of heat transfer outside the pipe tends to increase as a difference between the exhaust pipe temperature and the outside air temperature becomes large. Moreover, under forced-convection conditions, as the vehicle speed increases, the Reynolds number of the flow around the pipe increases and the rate of heat transfer outside the pipe tends to increase. The outside pipe heat transfer rate computing unit of block 405 in FIG. 4 has tabular data on the above-described relationship between a difference between the exhaust pipe temperature and the outside air temperature and the rate of heat transfer outside the pipe and the above-described relationship between the vehicle speed and the rate of heat transfer outside the pipe, and determines the rate of heat transfer outside the pipe by table computation based on the exhaust pipe temperature, the outside air temperature, and the vehicle speed. With this configuration, it is possible to pay due consideration to the influence of a difference between the exhaust pipe temperature and the outside air temperature and the vehicle speed on the rate of heat transfer outside the pipe and predict the exhaust pipe temperature with high accuracy.

Figure 7:
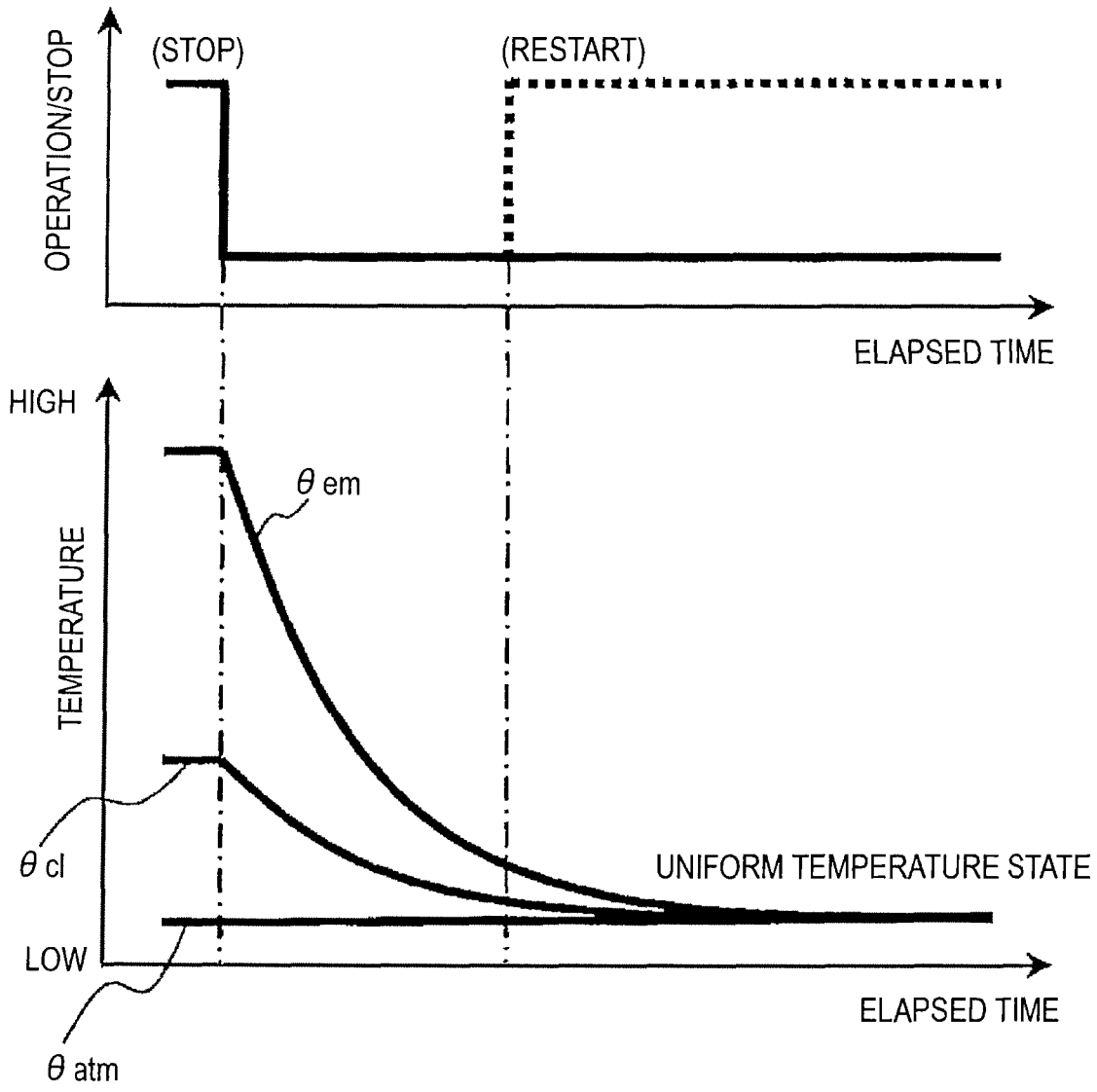
FIG. 7 is a diagram explaining transitions of the outside air temperature, the coolant temperature, and the exhaust pipe temperature after an internal combustion engine is stopped.

FIG. 7 is a diagram explaining transitions of the outside air temperature, the coolant temperature, and the exhaust pipe temperature after the internal combustion engine is stopped. As shown in FIG. 7, after the internal combustion engine is stopped, both a coolant temperature θcl and an exhaust pipe temperature θem drop in such a way as to converge at an outside air temperature θatm, and, after a sufficient time elapses, the state reaches a uniform temperature state. Therefore, it is possible to determine whether or not the state is a uniform temperature state depending on whether a difference between the outside air temperature and the coolant temperature is large or small. The coolant temperature and the outside air temperature are sensed at the time of start-up, and, when a difference between the coolant temperature and the outside air temperature is more than or equal to a predetermined value, the state is changing to the uniform temperature state. In this case, the exhaust pipe temperature at the time of start-up is determined based on Expression (1) below.

$$\theta em_ON = \theta atm_ON - (\theta em_OFF - \theta atm_OFF) \times \frac{(\theta cl_ON - \theta atm_ON)}{(\theta cl_OFF - \theta atm_OFF)} \quad (1)$$

where θem_OFF is the temperature of the exhaust pipe when the internal combustion engine is stopped, θem_ON is the temperature of the exhaust pipe when the internal combustion engine is restarted, θcl_OFF is the temperature of coolant when the internal combustion engine is stopped, θcl_ON is the temperature of coolant when the internal combustion engine is restarted, θatm_OFF is the outside air temperature when the internal combustion engine is stopped, and θatm_ON is the outside air temperature when the internal combustion engine is restarted.

The start-up exhaust pipe temperature computing unit of block 407 in FIG. 4 computes the initial value of the exhaust pipe temperature by using the relationship described in Expression (1) above. With this configuration, it is possible to compute the start-up exhaust pipe temperature with high accuracy, the start-up exhaust pipe temperature which is important in computing the mass of condensed water that develops from start-up until the exhaust pipe temperature reaches the dew point.

Figure 8:
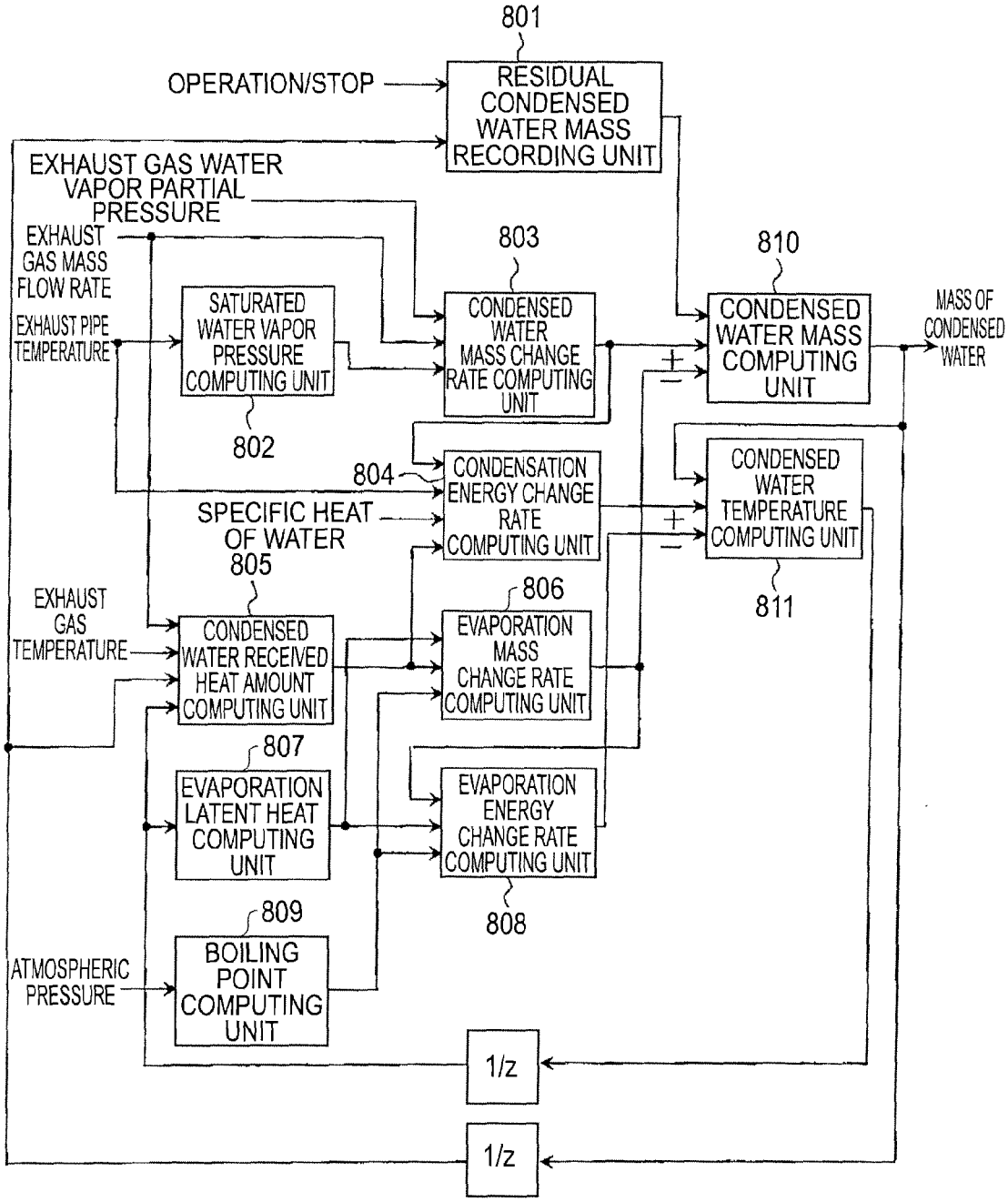
FIG. 8 is a block diagram showing how to compute the mass of condensed water based on the balance of mass and energy.

FIG. 8 is a block diagram showing how to compute the mass of condensed water based on the balance of mass and energy. This block diagram indicates the detailed computing processing in step 303 in FIG. 3.

In a residual condensed water mass recording unit of block 801, the mass of residual condensed water observed when the internal combustion engine 1 is stopped is recorded based on the operation/stop information, which is the operating state information of the internal combustion engine 1, and the previous value of the mass of condensed water. The residual condensed water mass recording unit of block 801 makes it possible to hold data on the mass of the residual condensed water even when the energization of the ECU 22 is interrupted and use the data for setting the initial value of the mass of condensed water when the internal combustion engine 1 is started next time.

In a saturated water vapor pressure computing unit of block 802, the saturated water vapor pressure is computed based on the exhaust pipe temperature. Then, in a condensed water mass change rate computing unit of block 803, the rate of change of condensed water mass in the exhaust pipe 41 is computed based on the water vapor partial pressure of the exhaust gas, the exhaust gas mass flow rate, and the saturated water vapor pressure. The rate of change of condensed water mass is the mass of water that condenses and increases per unit time.

In a condensation energy change rate computing unit of block 804, the rate of change of condensation energy is computed based on the rate of change of condensed water mass, the exhaust pipe temperature, the specific heat of water, and the amount of received heat of condensed water. The rate of change of condensation energy is the energy of water that condenses and increases per unit time.

In a condensed water received heat amount computing unit of block 805, the amount of received heat of condensed water is computed based on the exhaust gas mass flow rate, the exhaust gas temperature, the previous value of the mass of condensed water (the updated mass of condensed water), and the previous value of the condensed water temperature. When the amount of received heat of condensed water is computed, the rate of heat transfer inside the exhaust pipe, the rate computed in block 403 in FIG. 4, is taken into account.

In an evaporation mass change rate computing unit of block 806, the evaporation mass is computed based on the latent heat of evaporation, the amount of received heat of condensed water, and the boiling point. The rate of change of evaporation mass is the mass of water which evaporates and decreases per unit time.

In an evaporation latent heat computing unit of block 807, the latent heat of evaporation is computed based on the condensed water temperature.

In an evaporation energy change rate computing unit of block 808, the rate of change of evaporation energy is computed based on the latent heat of evaporation, the rate of change of evaporation mass, and the boiling point. The rate of change of evaporation energy is the energy of water which evaporates and decreases per unit time. In a boiling point computing unit of block 809, the boiling point is computed based on the atmospheric pressure.

In a condensed water mass computing unit of block 810, the mass of condensed water in the exhaust pipe 41 is updated based on the residual condensed water mass, the rate of change of condensed water mass, and the rate of change of evaporation mass. In a condensed water temperature computing unit of block 811, the condensed water temperature is computed based on the mass of condensed water, the rate of change of condensation energy, and the rate of change of evaporation energy.

As described above, in the condensed water mass change rate computing unit of block 803, the rate of change of condensed water mass of the condensed water which condenses in the exhaust pipe 41 is computed based on the water vapor partial pressure and the saturated water vapor pressure of the exhaust gas, and, in the evaporation mass change rate computing unit of block 806, the rate of change of evaporation mass of the condensed water in the exhaust pipe 41 is computed based on the amount of heat which the condensed water in the exhaust pipe 41 receives from the exhaust gas and the latent heat of evaporation. Then, in the condensed water mass computing unit of block 810, the mass of condensed water in the exhaust pipe 41 is updated based on both the amount of condensed water of block 803 and the amount of evaporated water of block 806. Therefore, it is possible to compute the mass of condensed water with high accuracy by paying close consideration to the physical phenomenon related to condensation and evaporation.

Figure 9:
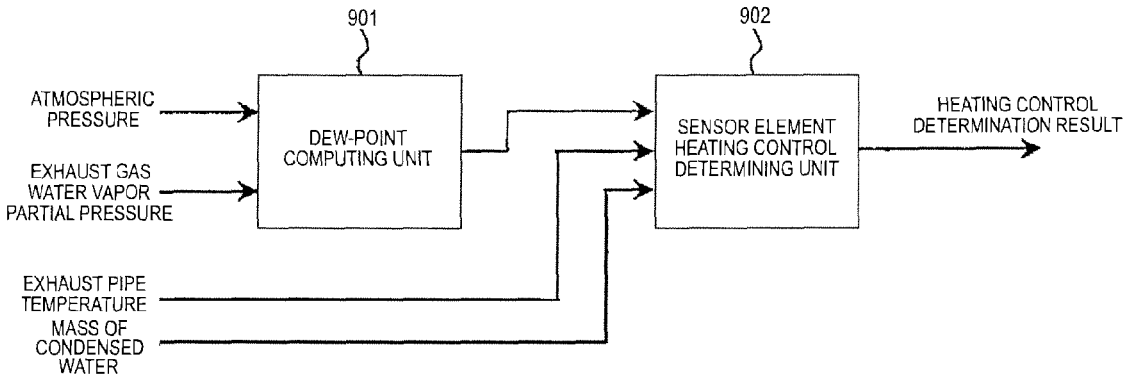
FIG. 9 is a block diagram showing how to determine whether or not to perform sensor element heating control.

FIG. 9 is a block diagram showing how to determine whether or not to perform sensor element heating control. This block diagram indicates the detailed computing processing in step 304 in FIG. 3. A dew-point computing unit of block 901 computes the dew point based on the atmospheric pressure and the water vapor partial pressure of the exhaust gas. In a sensor element heating control determining unit of block 902, it is determined whether or not to perform sensor element heating control of the air-fuel ratio sensor 20 based on the dew point, the exhaust pipe temperature, and the mass of condensed water. With this configuration, it is possible to prevent a sensor element crack of the air-fuel ratio sensor 20 appropriately, the sensor element crack associated with the adhesion of condensed water. However, the invention is not limited to this configuration, and a configuration in which it is determined whether or not to perform sensor element heating control of the air-fuel ratio sensor 20 based on the mass of condensed water and the time rate of change thereof can also produce similar advantages.

Figure 10A:
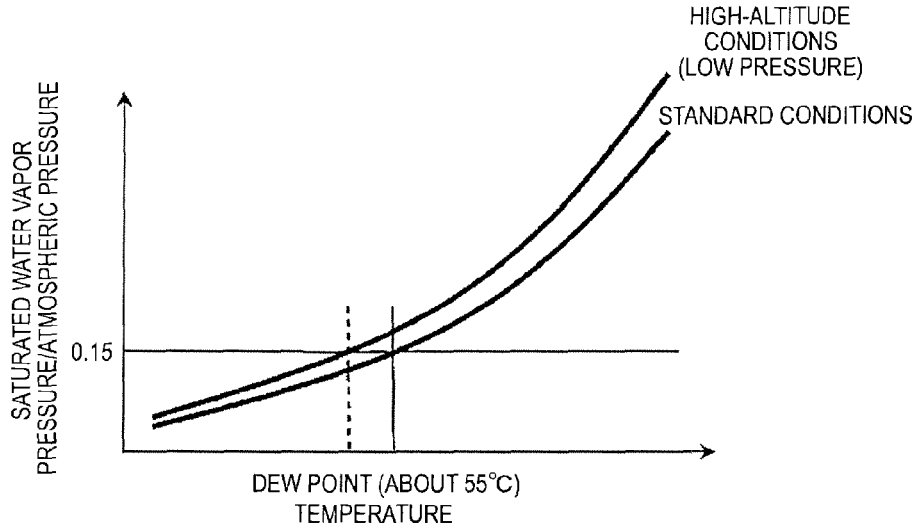
FIGS. 10A and 10B are diagrams explaining the relationship between the ratio between the saturated water vapor pressure and the atmospheric pressure and the temperature and the relationship between the ratio between the saturated water vapor pressure and the atmospheric pressure and the equivalence ratio.
Figure 10B:
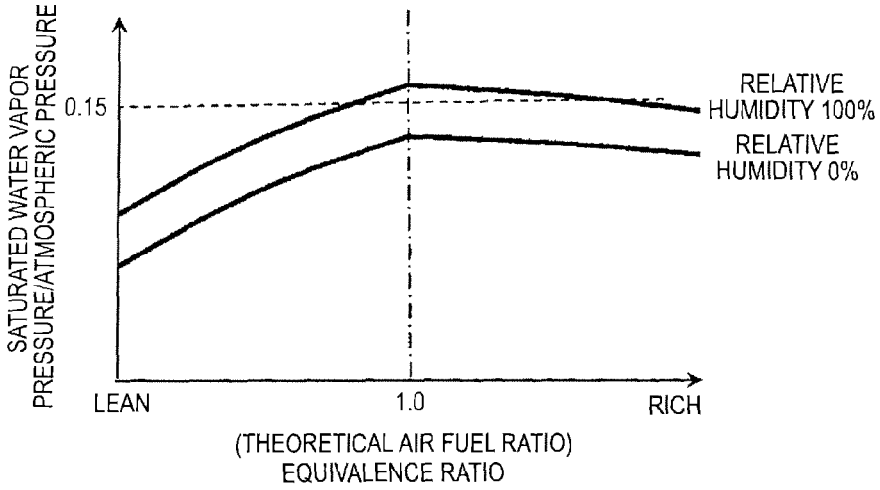

FIG. 10A is a diagram explaining the relationship between the ratio between the saturated water vapor pressure and the atmospheric pressure and the temperature, and FIG. 10B is a diagram explaining the relationship between the ratio between the saturated water vapor pressure and the atmospheric pressure and the equivalence ratio. As shown in FIG. 10A, the ratio between the saturated water vapor pressure and the atmospheric pressure tends to increase as the temperature increases. Moreover, under high-altitude conditions, since the atmospheric pressure decreases, the above-described ratio between the saturated water vapor pressure and the atmospheric pressure tends to increase. When the exhaust pipe temperature is gradually reduced from a high temperature and reaches the dew point, the water vapor condenses, and a water droplet begins to appear in the exhaust pipe. The molar fraction of the water vapor of the gas which is discharged when gasoline is ignited at a theoretical air fuel ratio is about 0.15, and the dew point corresponds to about 55° C. according to the above relationship. Moreover, under high-altitude conditions in which the atmospheric pressure is decreased, the dew point tends to decrease. The ratio between the saturated water vapor pressure and the atmospheric pressure changes depending on the air fuel ratio and tends to decrease toward both the lean side and the rich side with the boundary along the theoretical air fuel ratio. Furthermore, as the water vapor contained in the atmosphere increases, the ratio between the saturated water vapor pressure and the atmospheric pressure tends to increase. When the ratio between the saturated water vapor pressure and the atmospheric pressure increases, the dew point increases under the same atmospheric pressure conditions. In the dew-point computing unit of block 901 in FIG. 9, by computing the dew point by using the above-described relationship, it is possible to take the influence of the atmospheric pressure, the air fuel ratio, and the relative humidity on the dew point into consideration appropriately and predict the mass of condensed water with a high degree of accuracy.

Figure 11:
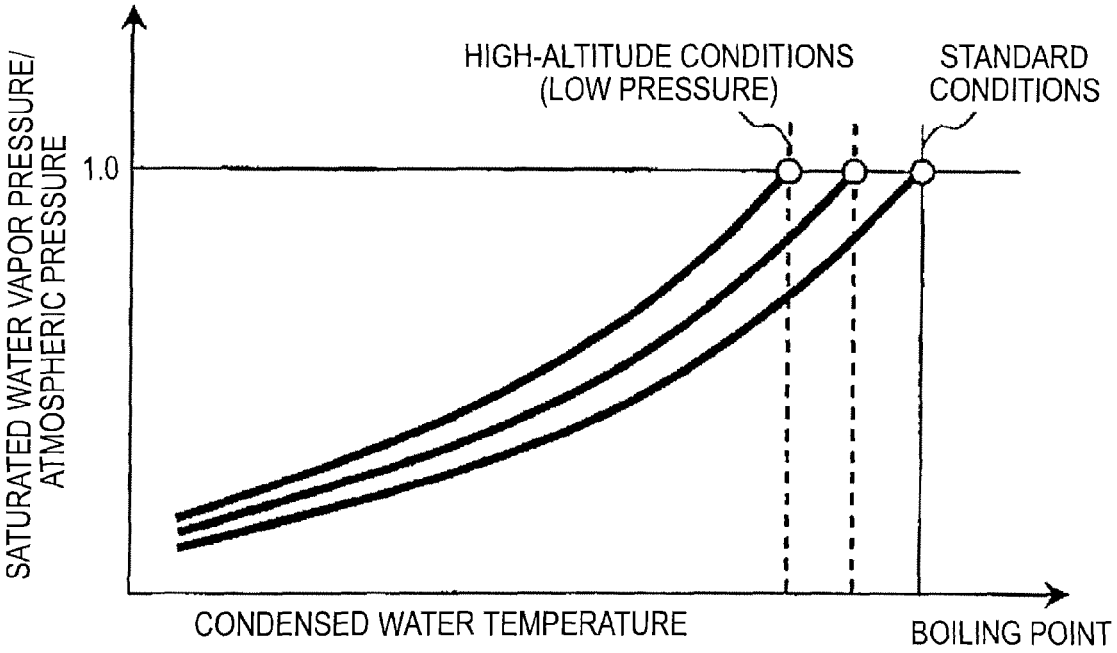
FIG. 11 is a diagram explaining the influence of a change in the atmospheric pressure on the boiling point.

FIG. 11 is a diagram explaining the influence of a change in the atmospheric pressure on the boiling point. This drawing indicates the relationship between the ratio between the saturated water vapor pressure and the atmospheric pressure and the condensed water temperature. Since the atmospheric pressure decreases as altitude increases, the ratio between the saturated water vapor pressure and the atmospheric pressure tends to increase at the same condensed water temperature. The boiling point at which the saturated water vapor pressure coincides with the atmospheric pressure tends to decrease under high-altitude conditions in which the atmospheric pressure decreases. In the boiling point computing unit of block 809 in FIG. 8, by computing the boiling point by using the above-described relationship, it is possible to take the influence of the atmospheric pressure on the boiling point into consideration appropriately and predict the mass of condensed water with a high degree of accuracy.

Figure 12:
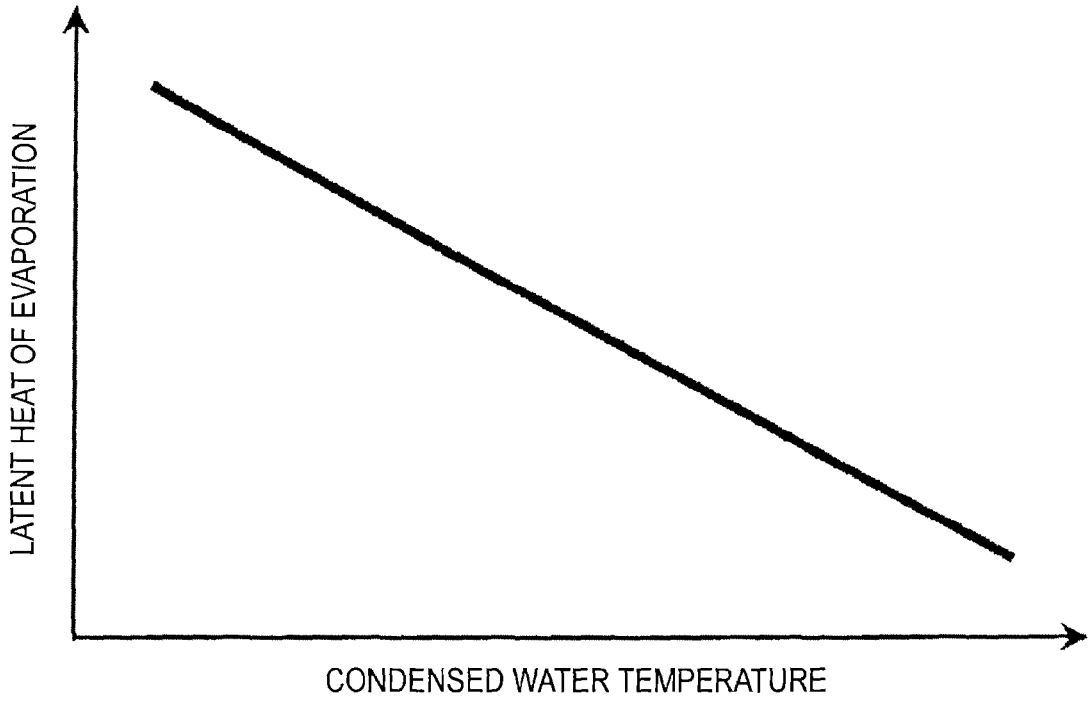
FIG. 12 is a diagram explaining the relationship between the latent heat of evaporation and the condensed water temperature.

FIG. 12 is a diagram explaining the relationship between the latent heat of evaporation and the condensed water temperature. As the temperature of condensed water increases, the latent heat of evaporation tends to decrease. In the evaporation latent heat computing unit of block 807 in FIG. 8, by computing the latent heat of evaporation by using the above-described relationship, it is possible to take the influence of the condensed water temperature on the latent heat of evaporation into consideration appropriately and predict the mass of condensed water with a high degree of accuracy.

Figure 13:
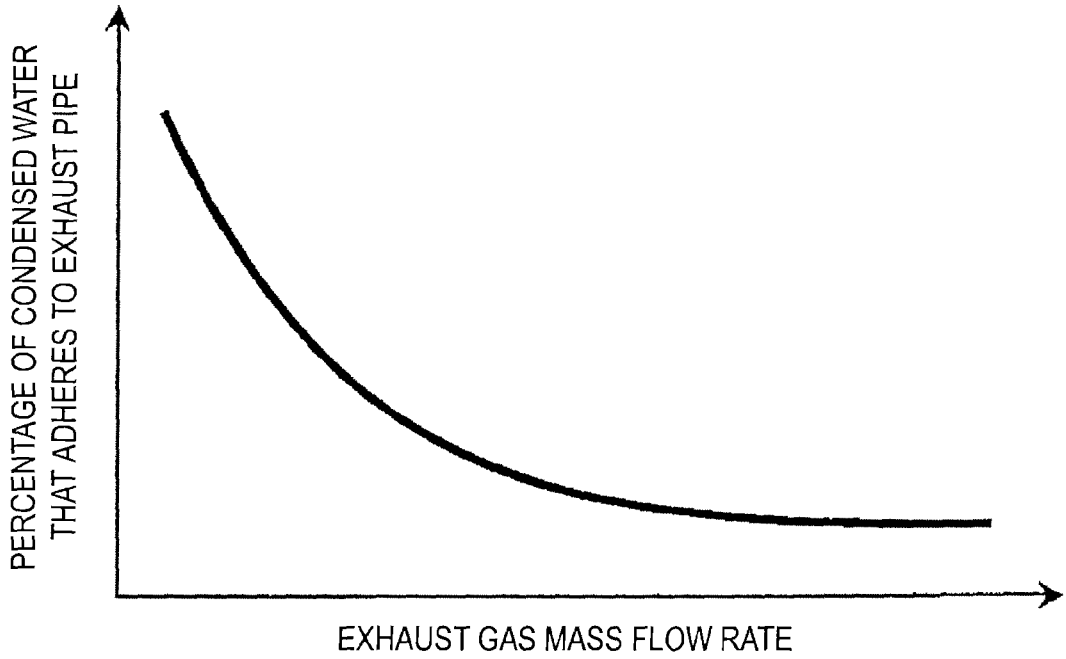
FIG. 13 is a diagram explaining the relationship between the percentage of the condensed water that adheres to the exhaust pipe and the exhaust gas mass flow rate.

FIG. 13 is a diagram explaining the relationship between the percentage of the condensed water that adheres to the exhaust pipe and the exhaust gas mass flow rate. In the condensed water mass change rate computing unit of block 803 in FIG. 8, the total mass of water that condenses and increases in the exhaust pipe 41 per unit time is computed based on a difference between the water vapor partial pressure of the exhaust gas and the saturated water vapor pressure/the atmospheric pressure and the product of the difference and the exhaust gas mass flow rate. A certain percentage of the water that condenses and increases per unit time adheres to the inner wall surface of the exhaust pipe 41 and builds up. As the exhaust gas mass flow rate increases, the percentage of the condensed water that adheres to the inner wall surface of the exhaust pipe 41 tends to increase. The condensed water mass change rate computing unit of block 803 in FIG. 8 has tabular data on the above-described relationship between the percentage of the condensed water that adheres to the exhaust pipe and the exhaust gas mass flow rate, and computes the percentage of the condensed water that adheres to the exhaust pipe by using the exhaust gas mass flow rate as an argument. Furthermore, the rate of change of condensed water mass is computed by multiplying the total mass of water that condenses and increases per unit time by the above-described percentage of the condensed water that adheres to the exhaust pipe. As described above, by taking the total mass of water that condenses and increases in the exhaust pipe 41 and the percentage of the condensed water that adheres to the inner wall surface of the exhaust pipe 41 into consideration, it is possible to compute the mass of condensed water with high accuracy, the mass of condensed water that influences the determination as to whether or not to perform sensor element heating control.

Figures 14A, 14B, 14C, 14D, 14E, 14F:
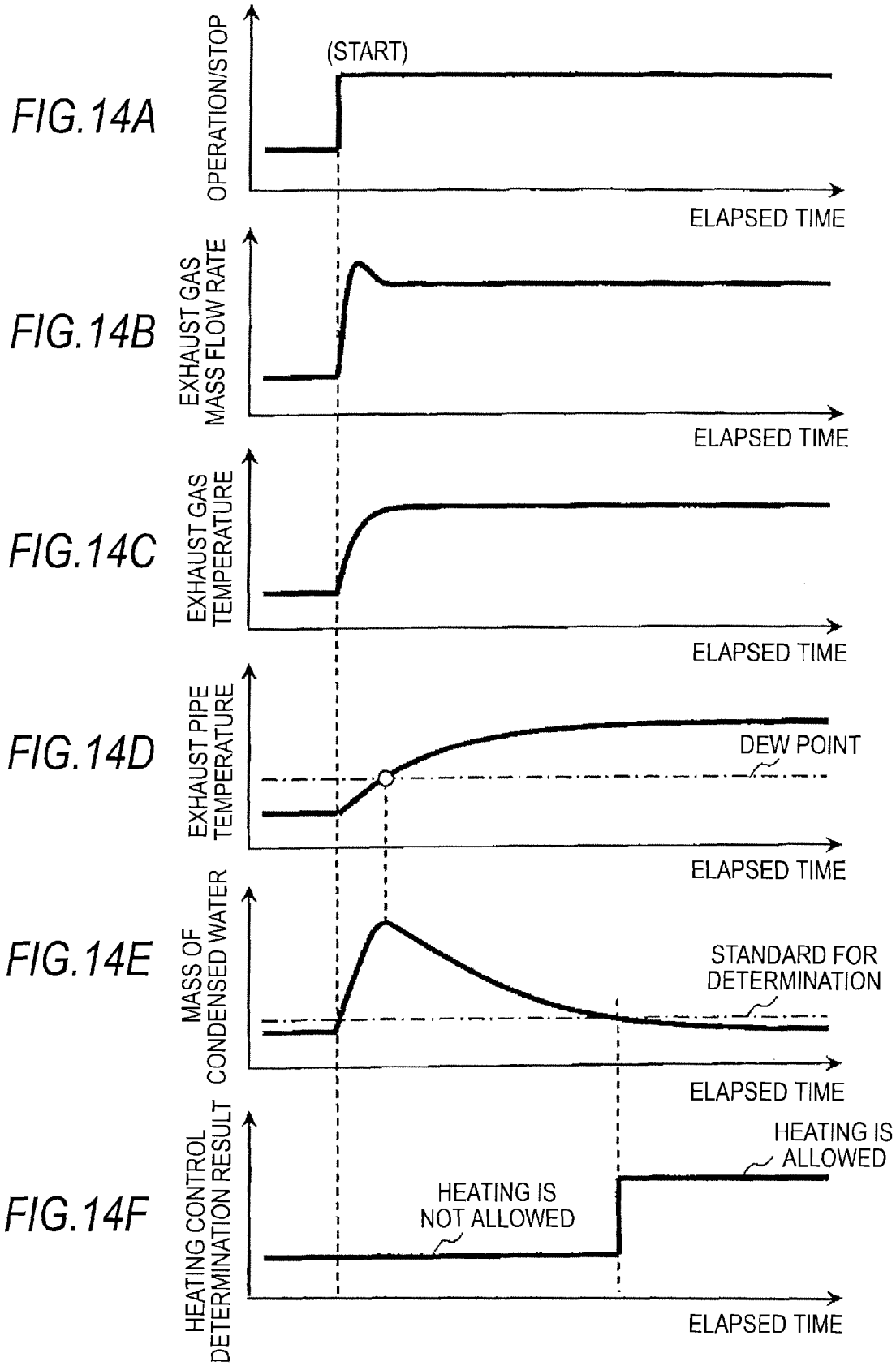
FIGS. 14A to 14F are diagrams explaining changes in the exhaust gas mass flow rate, the exhaust gas temperature, the exhaust pipe temperature, the mass of condensed water, and the heating control determination when the internal combustion engine is started.

FIGS. 14A to 14F are diagrams explaining changes in the exhaust gas mass flow rate, the exhaust gas temperature, the exhaust pipe temperature, the mass of condensed water, and the heating control determination when the internal combustion engine is started. FIGS. 14A to 14C indicate the transitions of the exhaust gas mass flow rate and the exhaust gas temperature after the internal combustion engine is started, FIG. 14D indicates the computation result of the exhaust pipe temperature obtained by the block diagram shown in FIG. 4, FIG. 14E indicates the computation result of the mass of condensed water obtained by the block diagram shown in FIG. 8, and FIG. 14F indicates the result of the determination as to whether or not to perform sensor element heating control, the result obtained by the block diagram shown in FIG. 9.

As shown in FIGS. 14A to 14C, after the internal combustion engine 1 is started, while the exhaust gas mass flow rate and the exhaust gas temperature immediately increase, the exhaust pipe temperature increases after a time lag. The mass of condensed water increases until the exhaust pipe temperature reaches the dew point and starts to decrease by evaporation when the exhaust pipe temperature rises above the dew point. It is determined that heating of the sensor element is possible when the mass of condensed water is at or below the standard for determination and the exhaust pipe temperature is above the dew point, and the sensor element heating control is started.

Figure 15A:
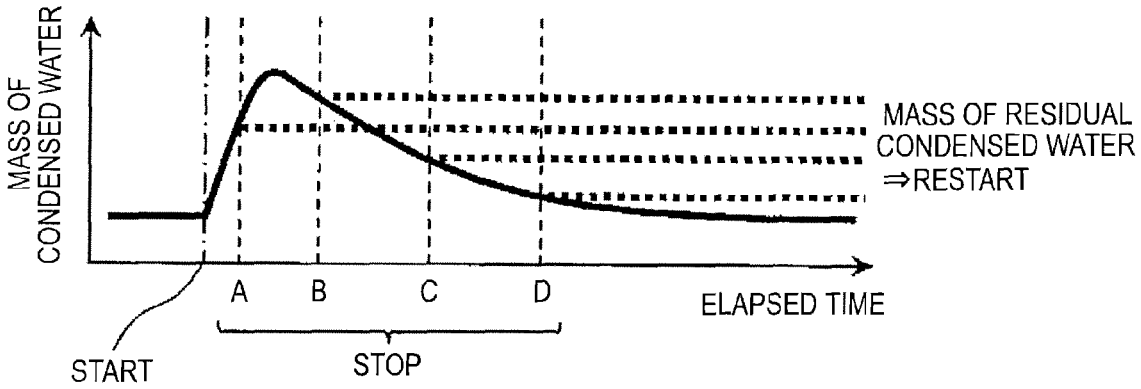
FIGS. 15A and 15B are diagrams explaining the relationship between a time point at which the engine is stopped and a period between a restart and a start of the sensor element heating control.
Figure 15B:
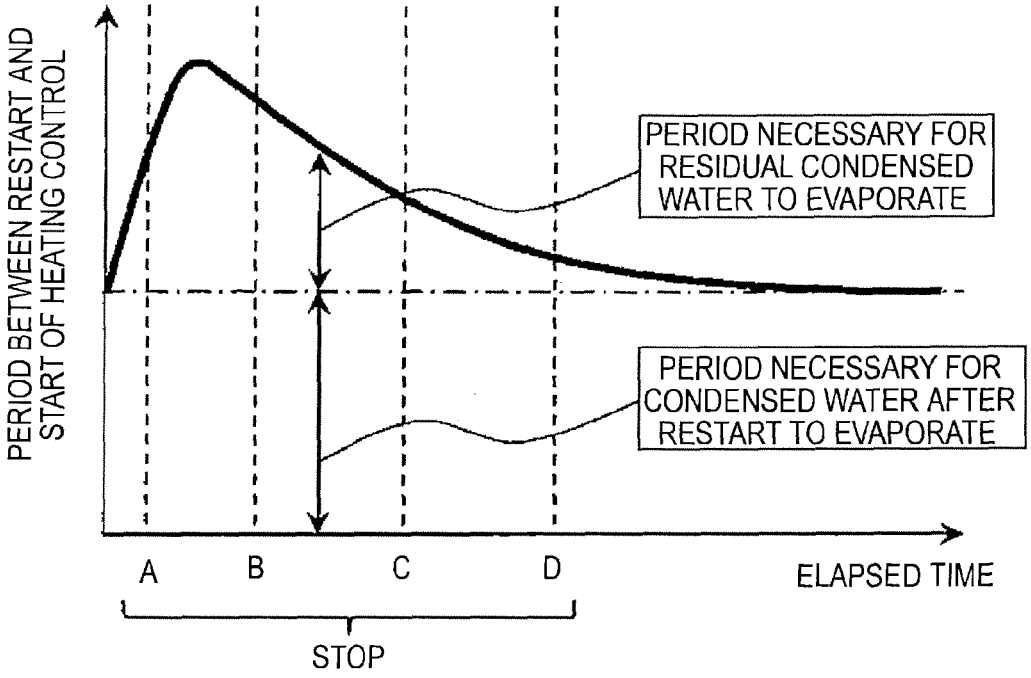

FIGS. 15A and 15B are diagrams explaining the relationship between a time point at which the internal combustion engine is stopped and a period between a restart and a start of the sensor element heating control. When a time point at which the internal combustion engine 1 is stopped is varied, the mass of residual condensed water remaining in the exhaust pipe 41 varies. In an example shown in FIG. 15A, the mass of residual condensed water becomes the largest when the internal combustion engine 1 is stopped at time point B, and is decreased in the order of time points A, C, and D.

As a result, a period necessary for allowing the residual condensed water and the condensed water that has developed after restart to evaporate completely varies depending on the mass of residual condensed water. Thus, as shown in FIG. 15B, depending on whether the internal combustion engine 1 is stopped at the time period A, B, C, or D, a period of time it takes to make the sensor element heating control possible after restart also varies. As described above, when the internal combustion engine 1 is started, stopped, and then started again, it is necessary to determine whether or not to perform sensor element heating control by taking the influence of the mass of residual condensed water into consideration.

Figures 16A, 16B, 16C, 16D, 16E, 16F:
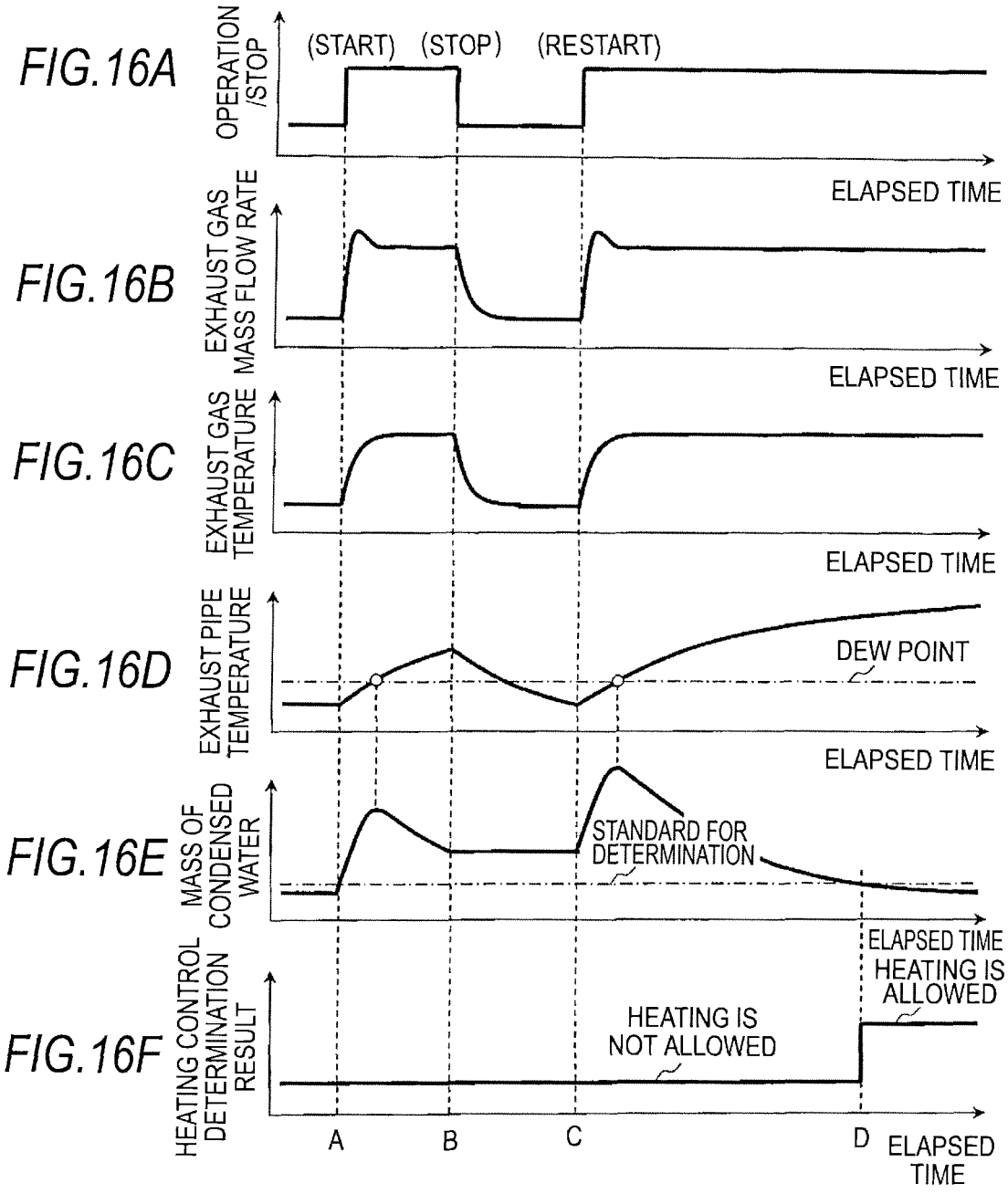
FIGS. 16A to 16F are diagrams explaining changes in the exhaust gas mass flow rate, the exhaust gas temperature, the exhaust pipe temperature, the mass of condensed water, and the sensor heating control determination when the internal combustion engine is started, stopped, and then started again.

FIGS. 16A to 16F are diagrams explaining changes in the exhaust gas mass flow rate, the exhaust gas temperature, the exhaust pipe temperature, the mass of condensed water, and the sensor heating control determination when the internal combustion engine is started, stopped, and then started again. FIGS. 16A to 16C indicate the transitions of the operating state of the internal combustion engine, the exhaust gas mass flow rate, and the exhaust gas temperature, FIG. 16D indicates the computation result of the exhaust pipe temperature obtained by the block diagram shown in FIG. 4, FIG. 16E indicates the computation result of the mass of condensed water obtained by the block diagram shown in FIG. 8, and FIG. 16F indicates the result of the determination as to whether or not to perform sensor element heating control, the result obtained by the block diagram shown in FIG. 9.

For example, in a vehicle having an idling stop controlling unit that performs control to stop idling of the internal combustion engine 1 while the vehicle is waiting for the traffic light to change, for example, and a hybrid engine vehicle using the internal combustion engine 1 and the driving force of the electric motor, the internal combustion engine 1 is started, stopped, and then started again in a short amount of time.

As shown in FIGS. 16A to 16C, while the exhaust gas mass flow rate and the exhaust gas temperature immediately increase or decrease when the internal combustion engine 1 is started or stopped, the exhaust pipe temperature tends to increase or decrease after a time lag. As shown in FIG. 16E, the mass of condensed water increases sharply until the exhaust pipe temperature reaches the dew point from the start-up temperature and starts to decrease gradually by evaporation when the exhaust pipe temperature is above the dew point. In an example shown in FIG. 16E, the mass of condensed water increases sharply until the exhaust pipe temperature exceeds the dew point from start-up point A and starts to decrease gradually when the exhaust pipe temperature exceeds the dew point.

Then, at stop point B, when the internal combustion engine is stopped before the mass of condensed water completely evaporates, the condensed water remains in the exhaust pipe 41 and becomes the condensed water at the next start-up point C. As described above, since the mass of condensed water observed when the exhaust pipe temperature reaches the dew point at the next start-up is increased by the remained condensed water, a period necessary for the condensed water to evaporate completely after the next start-up is also lengthened.

Then, the sensor element heating control is started at time point D under conditions that the mass of condensed water is at or below the standard for determination and the exhaust pipe temperature is above the dew point. As described above, even when the internal combustion engine 1 is started, stopped, and then started again, it is possible to determine whether or not to perform sensor element heating control with high accuracy.

FIGS. 17A to 17D are diagrams explaining the influences of the exhaust pipe initial temperature, the exhaust gas temperature, the exhaust gas mass flow rate, and the water vapor partial pressure of the exhaust gas on the transition of the mass of condensed water after start-up.

Figure 17A:
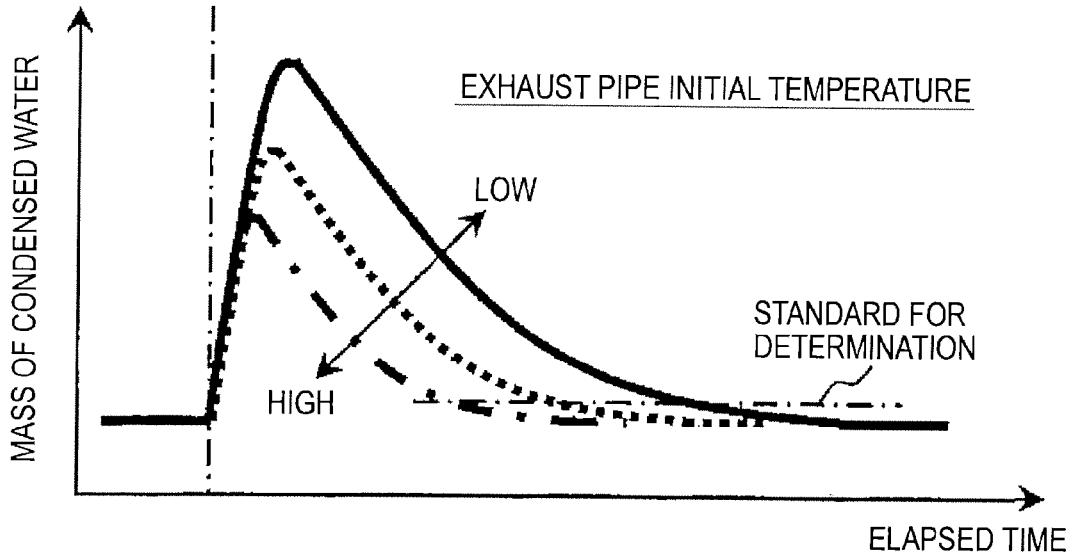
FIGS. 17A to 17D are diagrams explaining the influences of the exhaust pipe initial temperature, the exhaust gas temperature, the exhaust gas mass flow rate, and the water vapor partial pressure of the exhaust gas on the transition of the mass of condensed water after start-up.

At the same exhaust gas temperature and exhaust gas mass flow rate, as shown in FIG. 17A, the lower the exhaust pipe initial temperature, the longer a period necessary for the exhaust pipe temperature to reach the dew point and the larger the mass of condensed water during that period. Therefore, a period of time it takes for the condensed water to evaporate completely is lengthened.

Figure 17B:
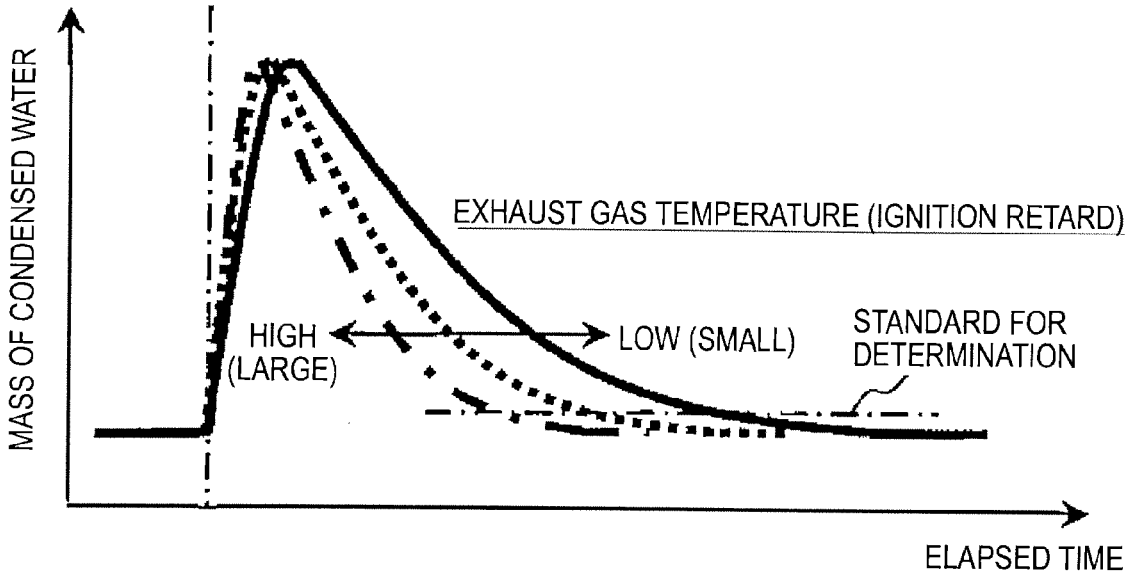

At the same exhaust gas mass flow rate and exhaust pipe initial temperature, as shown in FIG. 17B, as the exhaust gas temperature becomes higher, that is, as the ignition time point is retarded, a period necessary for the condensed water to evaporate completely is shortened.

Figure 17C:
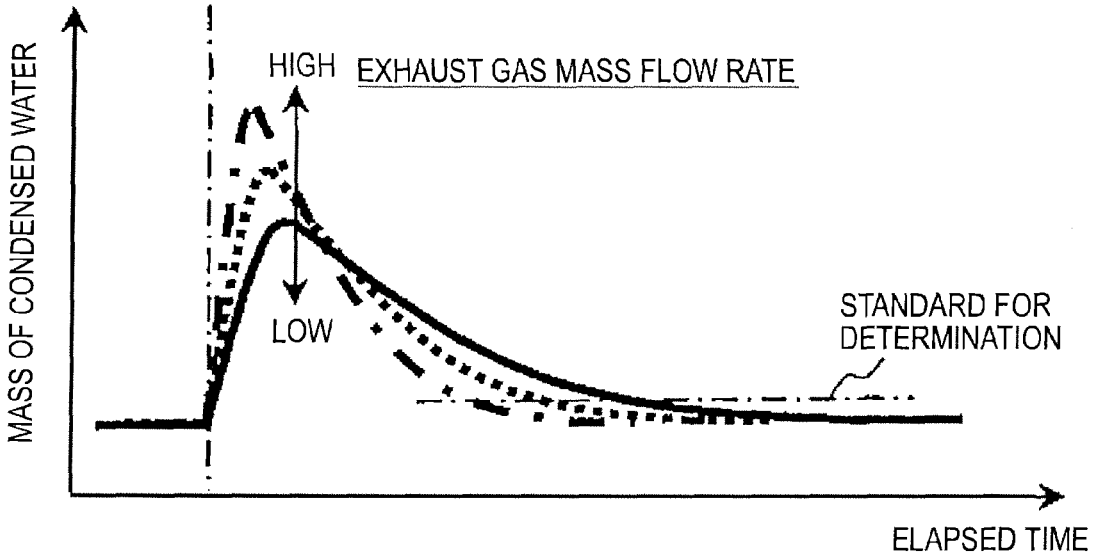

At the same exhaust gas temperature and exhaust pipe initial temperature, as shown in FIG. 17C, as the exhaust gas mass flow rate is increased, the mass of condensed water that develops until the exhaust pipe temperature reaches the dew point is increased and a period of time it takes for the condensed water to evaporate completely is shortened.

Figure 17D:
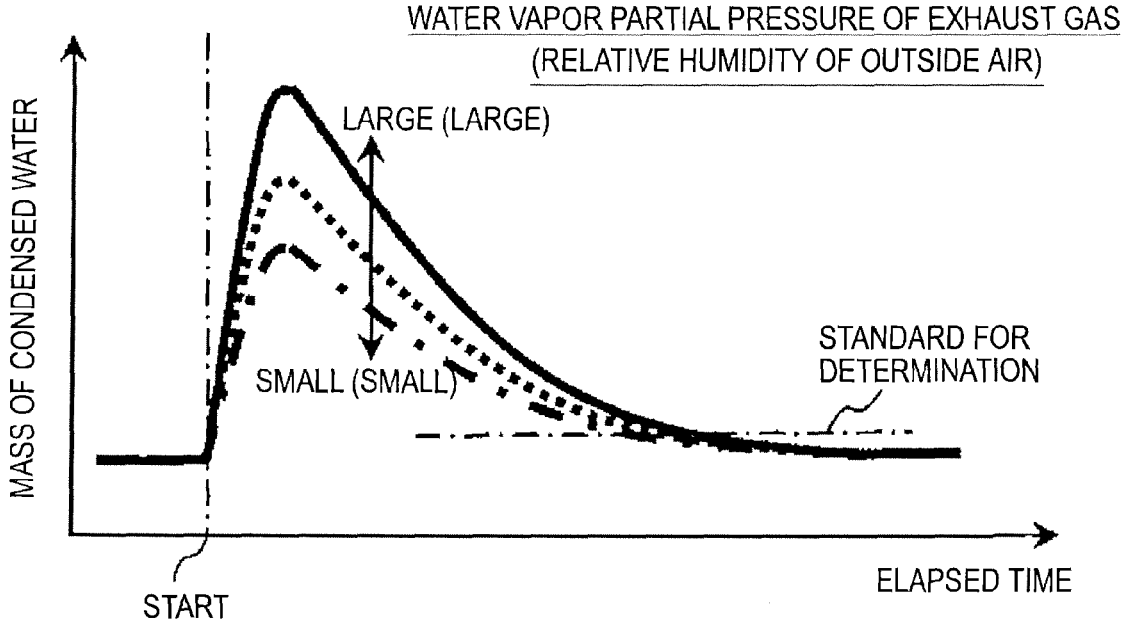

At the same exhaust gas temperature, exhaust gas mass flow rate, and exhaust pipe initial temperature, as shown in FIG. 17D, the higher the water vapor partial pressure of the exhaust gas, that is, the higher the relative humidity of the outside air, the larger the mass of condensed water becomes, and a period necessary for the condensed water to evaporate completely is lengthened.

As described above, even when the start-up conditions of the internal combustion engine vary, it is possible to determine whether or not to perform sensor element heating control with high accuracy because the influence on the condensation/evaporation processes is taken into consideration in step 303 of FIG. 3.

A control device of the internal combustion engine 1 in this embodiment has an exhaust gas temperature rise controlling unit that retards the ignition time point when the internal combustion engine is started and raises the temperature of the exhaust gas and an exhaust gas temperature rise control determining unit that allows the exhaust gas temperature rise controlling unit to perform exhaust gas temperature rise control when it is determined that the mass of condensed water is more than or equal to a predetermined value or the mass of condensed water is increasing. This makes it possible to evaporate the condensed water promptly, perform air-fuel ratio control at start-up quickly, and improve the exhaust performance. Incidentally, the above-described exhaust gas temperature rise controlling unit and exhaust gas temperature rise control determining unit are embodied through the execution of a program product which is previously set in the ECU 22.

Moreover, the control device of the internal combustion engine 1 in this embodiment has an intake air amount controlling unit that controls the amount of air sucked into the internal combustion engine and an operating range limiting unit that limits the operating range of the intake air amount control performed by the intake air amount controlling unit in such a way that the amount of increase in the air intake amount per unit time is less than or equal to a predetermined value when it is determined that the mass of condensed water is more than or equal to a predetermined value or the mass of condensed water is increasing. This makes it possible to prevent a crack in the sensor element when the condensed water that adheres to the inner wall surface of the exhaust pipe 41 is spattered due to a sudden increase in the air intake amount and the sensor element is immersed in water. The above-described intake air amount controlling unit and operating range limiting unit are embodied through the execution of a program product which is previously set in the ECU 22.

Furthermore, the control device of the internal combustion engine in this embodiment has an idling stop controlling unit that performs control to stop idling of the internal combustion engine and an idling stop control inhibiting unit that inhibits the idling stop control performed by the idling stop controlling unit when it is determined that the mass of condensed water is more than or equal to a predetermined value or the mass of condensed water is increasing.

Therefore, even under idling stop conditions, when the mass of condensed water is more than or equal to a predetermined value or the mass of condensed water is increasing, idling is continuously performed. This makes it possible to evaporate the condensed water promptly, perform air-fuel ratio control at start-up quickly, and improve the exhaust performance. With this configuration, in start-up operation of the internal combustion engine 1 which is repeatedly performed by the idling stop controlling unit, it is possible to prevent a crack in the sensor element of the air-fuel ratio sensor 20 appropriately, the crack which would appear when the sensor element of the air-fuel ratio sensor 20 is immersed in water. The above-described idling stop controlling unit and idling stop control inhibiting unit are embodied through the execution of a program product which is previously set in the ECU 22.

Moreover, the control device of the internal combustion engine in this embodiment has a unit that continuously changes the extent to which the sensor element is heated in accordance with the mass of condensed water and a unit that preheats the sensor element by a heating controlling unit based on the mass of condensed water when the amount of condensed water is more than or equal to a predetermined value. This makes it possible to prevent a crack in the sensor element of the air-fuel ratio sensor appropriately, the crack that would appear when the sensor element of the air-fuel ratio sensor is immersed in water, when the internal combustion engine is started and perform prompt heating control to heat the sensor element to the activation temperature.

According to the above-configured control device of the internal combustion engine 1, it is possible to compute the mass of condensed water in the exhaust pipe 41 with high accuracy and determine whether or not to perform sensor element heating control of the air-fuel ratio sensor 20 with high accuracy. This makes it possible to prevent a crack in the sensor element of the air-fuel ratio sensor 20 appropriately, the crack which would appear when the sensor element of the air-fuel ratio sensor 20 is immersed in water, when the internal combustion engine 1 is started and prevent a decrease in fuel efficiency and exhaust performance.

According to the above-configured control device of the internal combustion engine 1, since the value of residual condensed water is recorded when the internal combustion engine 1 is stopped and the recorded value of residual condensed water is set as the initial value of the amount of condensed water when the internal combustion engine 1 is started next time, it is possible to prevent a crack in the sensor element of the air-fuel ratio sensor 20 appropriately, the crack which would appear when the sensor element of the air-fuel ratio sensor 20 is immersed in water, even when the internal combustion engine 1 is started in a state in which the internal combustion engine 1 is started, stopped, and then started again before reaching a sufficiently warmed-up state.

Second Embodiment

Next, a second embodiment of the invention will be described. The feature of this embodiment is that the mass of condensed water is computed based on the transfer function of condensation and evaporation. It is to be noted that such components as are similar to those of the first embodiment are identified with the same reference numerals and their detailed descriptions will be omitted.

Figure 18:
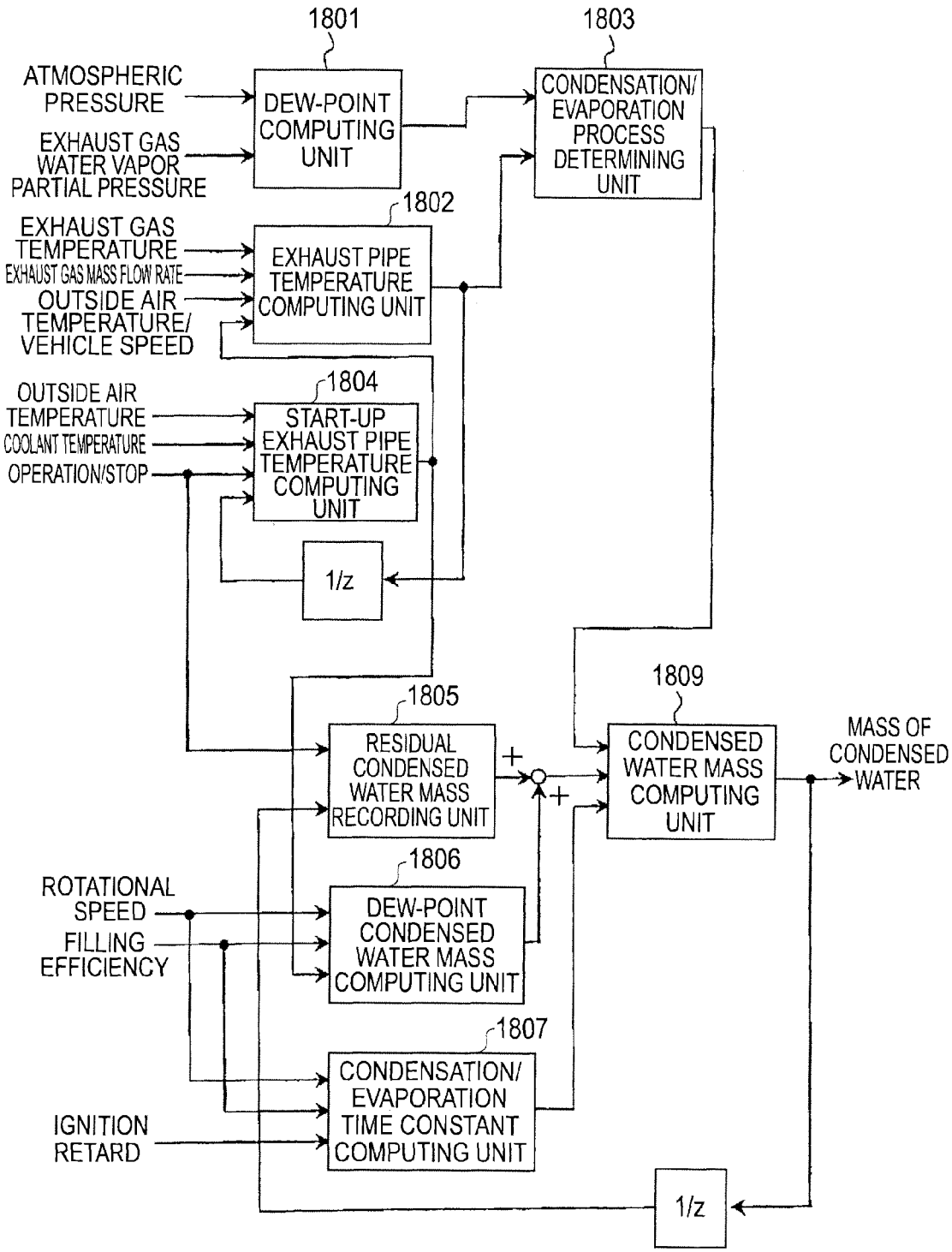
FIG. 18 is a block diagram showing how to compute the mass of condensed water based on the transfer function.

FIG. 18 is a block diagram showing how to compute the mass of condensed water based on the transfer function. This block diagram indicates the detailed computing processing in step 303 in FIG. 3. In a dew-point computing unit of block 1801, the dew point is computed based on the atmospheric pressure and the exhaust gas water vapor partial pressure. In an exhaust pipe temperature computing unit of block 1802, the exhaust pipe temperature is computed based on the exhaust gas temperature, the exhaust gas mass flow rate, the outside air temperature, the vehicle speed, and the start-up exhaust pipe temperature.

In a condensation/evaporation process determining unit of block 1803, it is determined whether the inside of the exhaust pipe 41 is in a condensation process or an evaporation process based on a comparison between the dew point and the exhaust pipe temperature. In a start-up exhaust pipe temperature computing unit of block 1804, the start-up exhaust pipe temperature is computed based on the outside air temperature, the coolant temperature, the operation/stop information of the internal combustion engine, and the exhaust pipe temperature.

In a residual condensed water mass recording unit of block 1805, the residual condensed water mass is recorded based on the operation/stop information of the internal combustion engine and the mass of condensed water. In a dew-point condensed water mass computing unit of block 1806, the mass of dew-point condensed water that develops from start-up until the exhaust pipe temperature reaches the dew point based on the rotational speed, the filling efficiency, and the start-up exhaust pipe temperature. In a condensation/evaporation time constant computing unit of block 1807, a time constant to approximate increase and decrease in the condensed water by a transfer function based on the rotational speed of the internal combustion engine, the filling efficiency, and an ignition time point controlled variable such as ignition retard. In a condensed water mass computing unit of block 1809, the mass of condensed water is computed based on the result of determination on the condensation/evaporation processes, the sum of the residual condensed water mass and the dew-point condensed water mass, and a first-order lag transfer function by using the time constant. This configuration eliminates the need to perform most of physical model computations related to the mass of condensed water in the ECU 22 on an onboard basis and makes it possible to reduce computation loads greatly.

Figure 19:
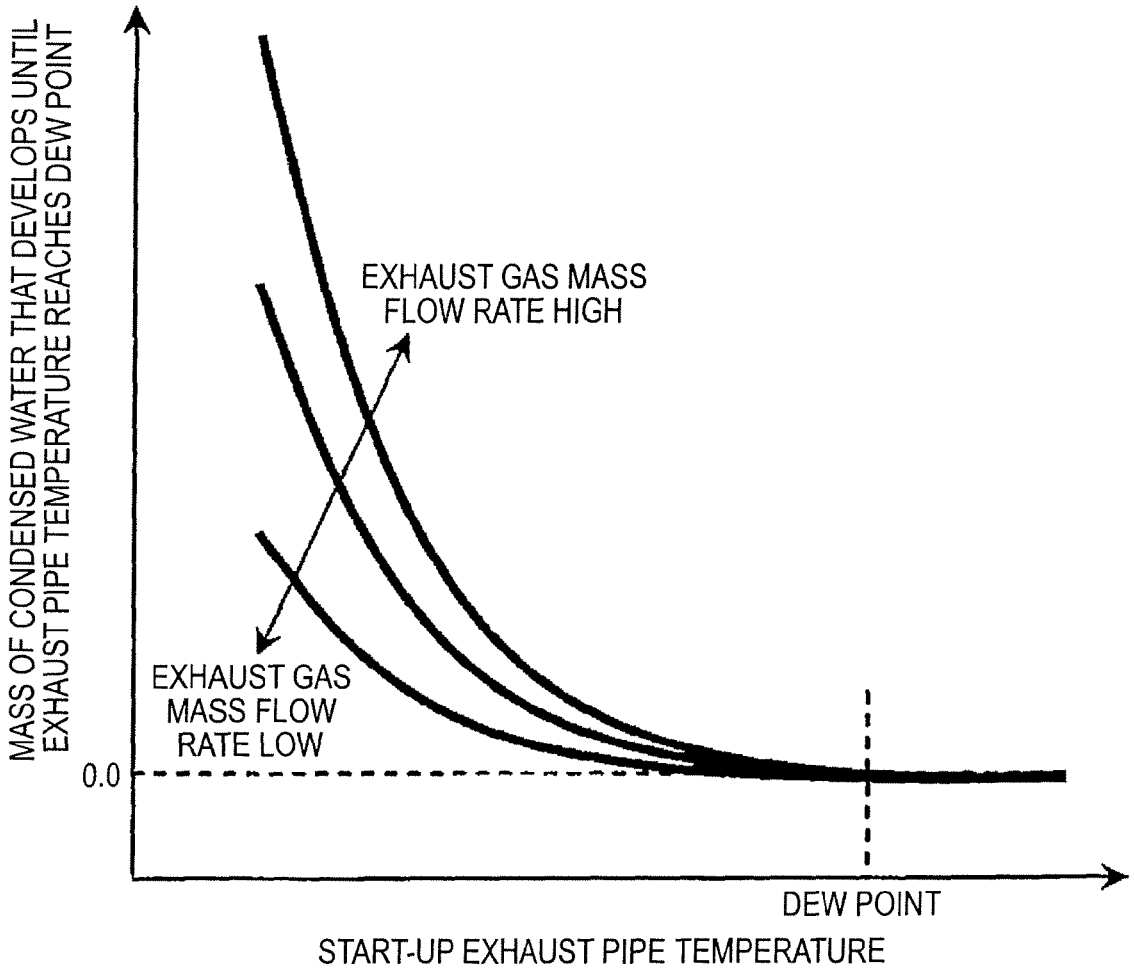
FIG. 19 is a diagram explaining the relationship between the mass of condensed water that develops from start-up until the exhaust pipe temperature reaches the dew point and the start-up exhaust pipe temperature.

FIG. 19 is a diagram explaining the relationship between the mass of condensed water that develops from start-up until the exhaust pipe temperature reaches the dew point and the start-up exhaust pipe temperature. As the start-up exhaust pipe temperature falls and the exhaust gas mass flow rate increases, the mass of condensed water that develops from start-up until the exhaust pipe temperature reaches the dew point increases. When the start-up exhaust pipe temperature is above the dew point, no condensed water develops. The dew-point condensed water mass computing unit of block 1806 in FIG. 18 has tabular data on the above-described relationship and computes the mass of dew-point condensed water that develops until the exhaust pipe temperature reaches the dew point by using the start-up exhaust pipe temperature and the exhaust gas mass flow rate as arguments. By taking such a relationship into consideration, it is possible to compute the mass of dew-point condensed water with high accuracy, the mass of dew-point condensed water that develops from start-up until the exhaust pipe temperature reaches the dew point.

Figure 20A:
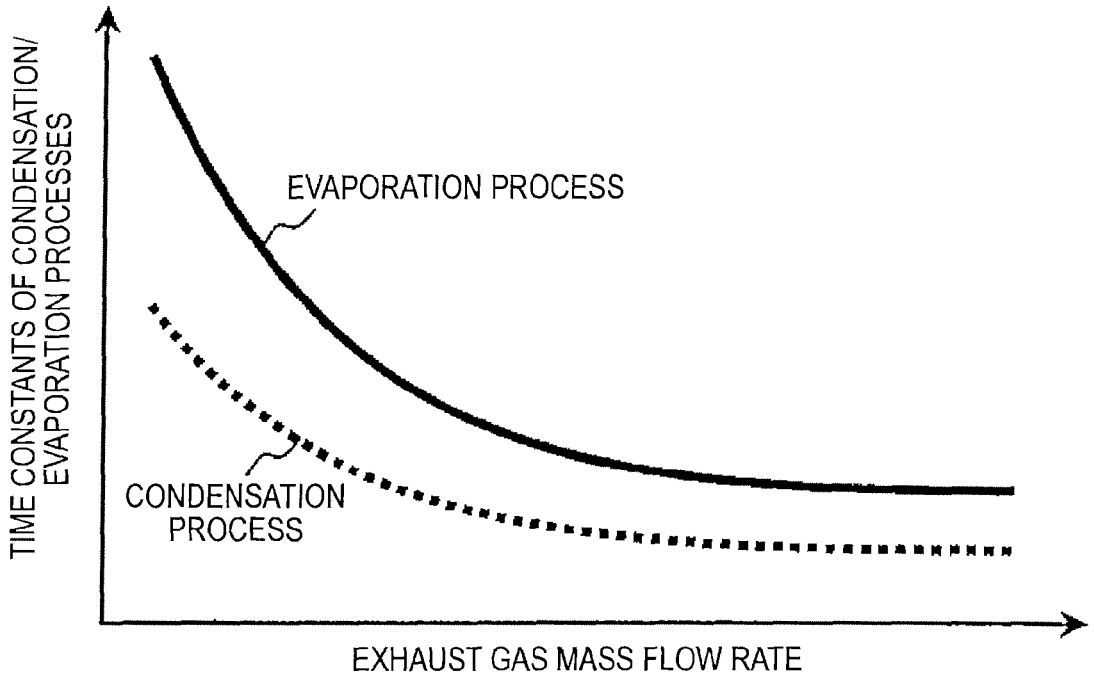
FIGS. 20A and 20B are diagrams explaining the relationship between the time constants of condensation/evaporation processes and the exhaust gas mass flow rate and the relationship between the time constants of the condensation/evaporation processes and ignition retard.
Figure 20B:
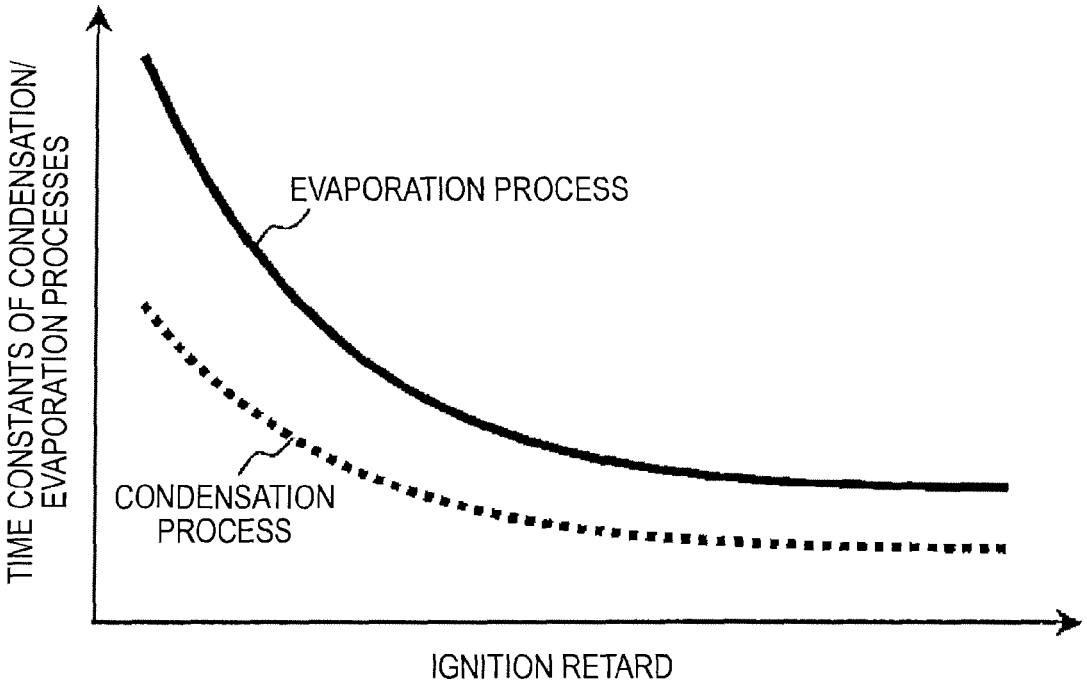

FIG. 20A is a diagram explaining the relationship between the time constants of condensation/evaporation processes and the exhaust gas mass flow rate, and FIG. 20B is a diagram explaining the relationship between the time constants of the condensation/evaporation processes and ignition retard. As shown in FIG. 20A, as the exhaust gas mass flow rate increases, the time constant to approximate a speed at which the condensed water increases by condensation decreases, and the time constant to approximate a speed at which the condensed water decreases by evaporation decreases.

Moreover, as shown in FIG. 20B, as the ignition time point is retarded, the time constant to approximate a speed at which the condensed water increases by condensation decreases, and the time constant to approximate a speed at which the condensed water decreases by evaporation decreases. Under warming-up conditions at the same exhaust gas mass flow rate and ignition time point, the time constant to approximate a speed at which the condensed water increases by condensation is set at a time constant smaller than the time constant to approximate a speed at which the condensed water decreases by evaporation.

The condensation/evaporation time constant computing unit of block 1807 in FIG. 18 has tabular data on the above-described relationship and computes the time constant by using the exhaust gas mass flow rate and ignition retard as arguments. By taking such a relationship into consideration, it is possible to set appropriately the time constants to approximate speeds at which the condensed water increases and decreases by condensation and evaporation and predict the mass of condensed water with high accuracy. Incidentally, in this embodiment, the time constant is determined by table computation by using the exhaust gas mass flow rate and ignition retard as arguments. However, the invention is not limited to this configuration. That is, a configuration in which the time constant is determined by table computation by reducing it to other parameters related to the condensation/evaporation processes can produce similar advantages.

Figures 21A, 21B, 21C, 21D, 21E, 21F:
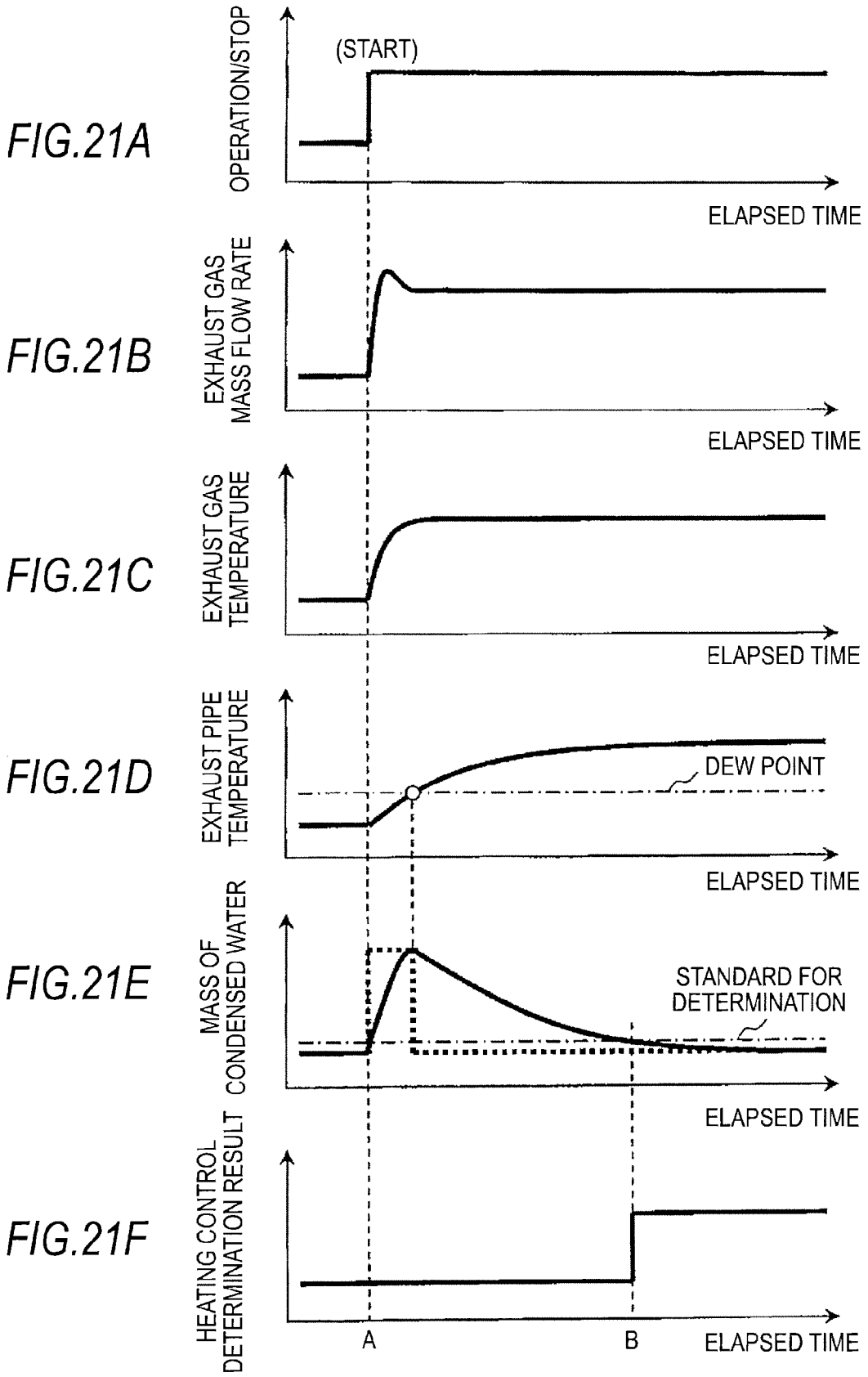
FIGS. 21A to 21F are diagrams explaining changes in the exhaust gas mass flow rate, the exhaust gas temperature, the exhaust pipe temperature, the mass of condensed water, and the heating control determination when the internal combustion engine is started.

FIGS. 21A to 21F are diagrams explaining changes in the exhaust gas mass flow rate, the exhaust gas temperature, the exhaust pipe temperature, the mass of condensed water, and the heating control determination when the internal combustion engine is started. FIGS. 21A to 21C indicate the transitions of the exhaust gas mass flow rate and the exhaust gas temperature after the internal combustion engine is started, FIG. 21D indicates the computation result of the exhaust pipe temperature obtained by the block diagram shown in FIG. 4, FIG. 21E indicates the computation result of the mass of condensed water obtained by the block diagram shown in FIG. 18, and FIG. 21F indicates the result of the determination as to whether or not to perform sensor element heating control, the result obtained by the block diagram shown in FIG. 9.

As shown in FIGS. 21A to 21D, after the internal combustion engine is started, while the exhaust gas mass flow rate and the exhaust gas temperature immediately increase, the exhaust pipe temperature increases after a time lag. As shown in FIG. 21E, the mass of condensed water increases according to a first-order lag transfer function using the mass of condensed water at the dew point (the dew-point condensed water mass) as an input (corresponding to a thick broken line in FIG. 21E) in a period in which the exhaust pipe temperature rises from a start-up temperature and reaches the dew point.

When the exhaust pipe temperature rises above the dew point, the mass of condensed water decreases according to a first-order lag transfer function using zero as an input (corresponding to the thick broken line in FIG. 21E). Then, at time point B, under conditions that the mass of condensed water is at or below the standard for determination and the exhaust pipe temperature is above the dew point, the sensor element heating control is started.

Figures 22A, 22B, 22C, 22D, 22E, 22F:
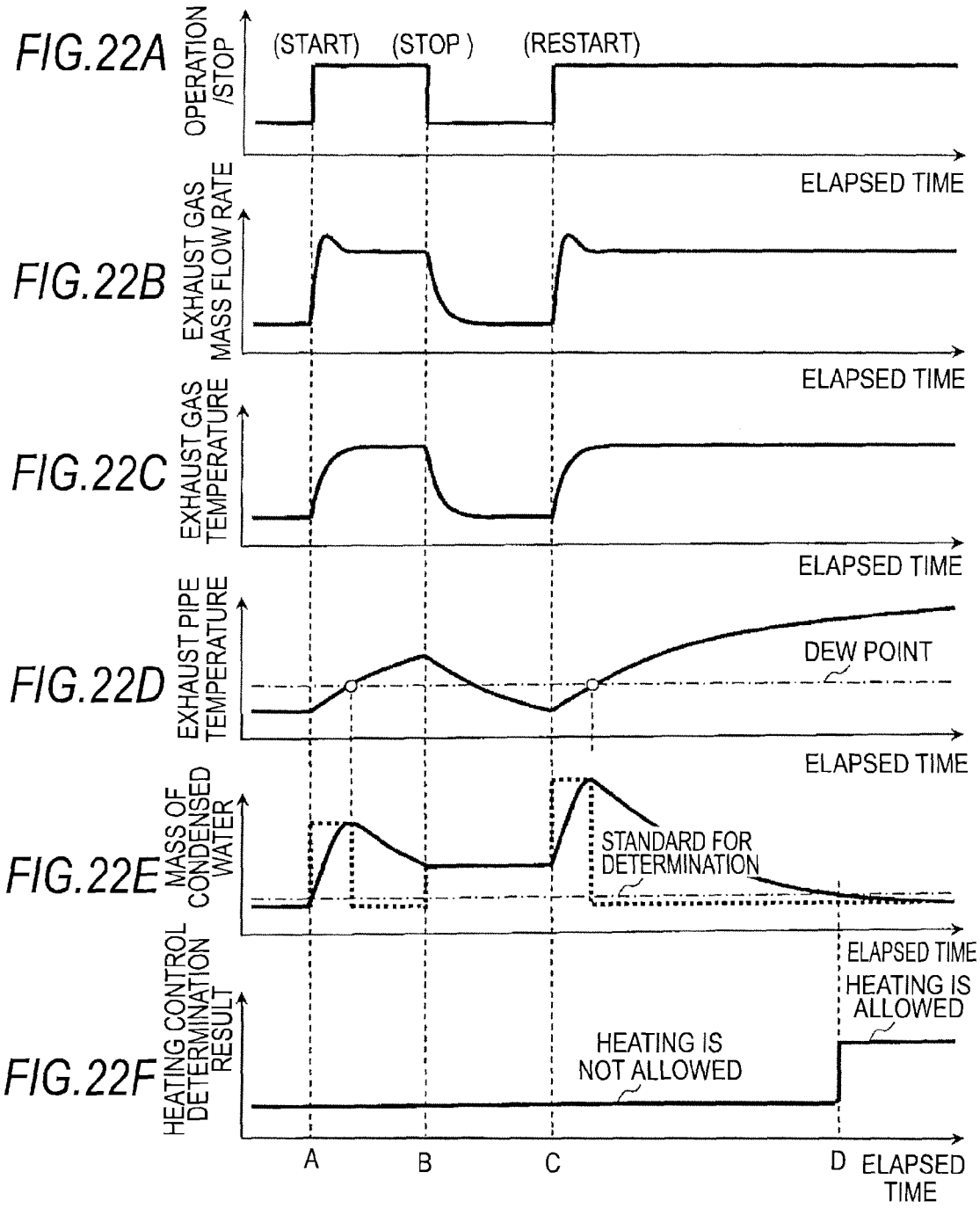
FIGS. 22A to 22F are diagrams explaining changes in the exhaust gas mass flow rate, the exhaust gas temperature, the exhaust pipe temperature, the mass of condensed water, and the sensor heating control determination result when the internal combustion engine is started, stopped, and then started again.

FIGS. 22A to 22F are diagrams explaining changes in the exhaust gas mass flow rate, the exhaust gas temperature, the exhaust pipe temperature, the mass of condensed water, and the sensor heating control determination result when the internal combustion engine is started, stopped, and then started again. FIGS. 22A to 22C indicate the transitions of the operating state of the internal combustion engine, the exhaust gas mass flow rate, and the exhaust gas temperature, FIG. 22D indicates the computation result of the exhaust pipe temperature obtained by the block diagram shown in FIG. 4, FIG. 22E indicates the computation result of the mass of condensed water obtained by the block diagram shown in FIG. 18, and FIG. 22F indicates the result of the determination as to whether or not to perform sensor element heating control, the result obtained by the block diagram shown in FIG. 9.

In a vehicle having an idling stop controlling unit that performs control to stop idling of the internal combustion engine 1 and a hybrid engine vehicle using the internal combustion engine 1 and the driving force of the electric motor, as shown in FIG. 22A, the internal combustion engine 1 is started, stopped, and then started again in a short amount of time.

In this case, as shown in FIG. 22E, the mass of condensed water increases according to a first-order lag transfer function using the mass of condensed water at the dew point (the dew-point condensed water mass) as an input (corresponding to a thick broken line in FIG. 22E) in a period in which the exhaust pipe temperature rises from a start-up temperature and reaches the dew point. At the exhaust pipe temperature above the dew point, the mass of condensed water decreases according to a first-order lag transfer function using zero as an input (corresponding to the thick broken line in FIG. 22E).

Then, at stop point B, when the internal combustion engine 1 is stopped before the mass of condensed water evaporates completely, the condensed water remains in the exhaust pipe 41 and becomes the condensed water at the next start-up point C. As described above, since the mass of condensed water observed when the exhaust pipe temperature reaches the dew point at the next start-up is increased by the remained condensed water, an increase is added to the input (corresponding to a broken line in FIGS. 22A to 22F) and a period necessary for the condensed water to evaporate completely is also lengthened. Then, after the next start-up, the sensor element heating control is started at time point D under conditions that the mass of condensed water is at or below the standard for determination and the exhaust pipe temperature is above the dew point. As described above, even when the internal combustion engine 1 is started, stopped, and then started again, it is possible to determine whether or not to perform sensor element heating control with high accuracy.

Although the embodiments of the invention have been described in detail, the invention is not limited to the embodiments described above and various design changes can be made therein without departing from the spirit of the invention claimed in the appended claims. For example, the above-mentioned embodiments have been described in detail to explain the invention in an easy-to-understand manner, and the invention is not necessarily limited to an embodiment with all the configurations described in the above-mentioned embodiments. Moreover, part of the configuration of an embodiment can be replaced with a configuration of another embodiment. In addition, to the configuration of an embodiment, a configuration of another embodiment can be added. Furthermore, to part of the configuration of each embodiment, another configuration can be added, part of the configuration of each embodiment can be deleted, and part of the configuration of each embodiment can be replaced with another configuration.

What is claimed is:

1. A control device of an internal combustion engine, the control device provided with a heating controlling unit configured to heat a sensor element of a sensor provided in an exhaust pipe, the sensor configured to detect an exhaust gas component, the control device comprising:

a saturated water vapor pressure computing unit configured to compute a saturated water vapor pressure of exhaust gas passing through the exhaust pipe based on an exhaust pipe temperature of the exhaust pipe;

a condensed water mass change rate computing unit configured to compute a rate of change of condensed water mass in the exhaust pipe based at least in part on the saturated water vapor pressure and an exhaust gas mass flow rate;

a condensed water received heat amount computing unit configured to compute an amount of received heat which the condensed water mass receives from the exhaust gas;

an evaporation latent heat computing unit configured to compute latent heat of evaporation associated with evaporation of the condensed water mass;

an evaporation mass change rate computing unit configured to compute a rate of change of evaporation mass in the exhaust pipe based on the amount of heat which condensed water in the exhaust pipe receives and latent heat of evaporation;

a condensed water mass computing unit configured to update the mass of condensed water in the exhaust pipe based on the rate of change of condensed water mass and the rate of change of evaporation mass;

a heating control determining unit configured to perform heating control determination as to whether to perform heating control by the heating controlling unit based on the updated mass of condensed water, wherein the control device is configured to communicate electronically with the heating controlling unit by sending a signal based on the determination;

a unit configured to change continuously the extent to which the sensor element is heated in accordance with the mass of condensed water; and a unit configured to preheat the sensor element by the heating controlling unit based on the mass of condensed water when the mass of condensed water is more than or equal to a predetermined value.

2. The control device of an internal combustion engine according to claim 1, further comprising:

a condensation energy change rate computing unit configured to compute a rate of change of condensation energy of the condensed water based on the rate of change of condensed water mass;

an evaporation energy change rate computing unit configured to compute a rate of change of evaporation energy of the condensed water based on the rate of change of evaporation mass; and a condensed water temperature computing unit configured to compute a condensed water temperature based on the rate of change of condensation energy and the rate of change of evaporation energy, wherein the condensed water received heat amount computing unit is configured to compute the amount of received heat of condensed water based on the condensed water temperature, the updated mass of condensed water, the exhaust gas mass flow rate, and the exhaust gas temperature.

3. The control device of an internal combustion engine according to claim 1, further comprising:

a residual condensed water mass recording unit configured to record the mass of condensed water observed when the internal combustion engine is stopped as a residual condensed water mass, wherein the condensed water mass computing unit is configured to set the residual condensed water mass recorded in the residual condensed water mass recording unit when the internal combustion engine is stopped last time as an initial value of the mass of condensed water at startup of the internal combustion engine.

4. The control device of an internal combustion engine according to claim 1, wherein the condensed water mass change rate computing unit is configured to compute the percentage of the condensed water that adheres to an inner wall surface of the exhaust pipe based on an exhaust gas mass flow rate and compute the rate of change of condensed water mass by using the computed percentage of the condensed water that adheres to the inner wall surface of the exhaust pipe.

5. The control device of an internal combustion engine according to claim 1, comprising:

an exhaust gas temperature rise controlling unit configured to perform exhaust gas temperature rise control to retard an ignition time point when the internal combustion engine is started and raise the temperature of the exhaust gas; and an exhaust gas temperature rise control determining unit configured to allow the exhaust gas temperature rise controlling unit to perform the exhaust gas temperature rise control when the mass of condensed water is determined to be more than or equal to a predetermined value or the mass of condensed water is determined to be increasing.

6. The control device of an internal combustion engine according to claim 1, comprising:

an intake air amount controlling unit configured to control the amount of air sucked into the internal combustion engine; and an operating range limiting unit configured to limit an operating range of intake air amount control performed by the intake air amount controlling unit in such a way that the amount of increase in the air intake amount per unit time is less than or equal to a predetermined value when the mass of condensed water is determined to be more than or equal to a predetermined value or the mass of condensed water is determined to be increasing.

7. The control device of an internal combustion engine according to claim 1, comprising:

an idling stop controlling unit configured to perform control to stop idling of the internal combustion engine; and an idling stop control inhibiting unit configured to inhibit the idling stop control performed by the idling stop controlling unit when the mass of condensed water is determined to be more than or equal to a predetermined value or the mass of condensed water is determined to be increasing.

* * * * *